US006773857B2

(12) United States Patent
Nakamura et al.

(10) Patent No.: US 6,773,857 B2
(45) Date of Patent: Aug. 10, 2004

(54) ELECTROPHOTOGRAPHIC PHOTORECEPTOR, PROCESSES FOR PRODUCING THE SAME, PROCESS CARTRIDGE, AND ELECTROPHOTOGRAPHIC APPARATUS

(75) Inventors: Hirofumi Nakamura, Minamiashigara (JP); Ichiro Takegawa, Minamiashigara (JP); Hidemi Nukada, Minamiashigara (JP); Masahiro Iwasaki, Minamiashigara (JP); Michiko Aida, Minamiashigara (JP); Yukiko Kamijo, Minamiashigara (JP); Masahiko Miyamoto, Minamiashigara (JP); Tetsuya Ezumi, Minamiashigara (JP); Takashi Yamada, Minamiashigara (JP); Koji Bando, Minamiashigara (JP); Taketoshi Hoshizaki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 108 days.

(21) Appl. No.: 10/265,783

(22) Filed: Oct. 8, 2002

(65) Prior Publication Data

US 2003/0118927 A1 Jun. 26, 2003

(30) Foreign Application Priority Data

Oct. 9, 2001 (JP) ..... 2001-311869
Mar. 8, 2002 (JP) ..... 2002-064162
Jul. 29, 2002 (JP) ..... 2002-220100

(51) Int. Cl.[7] ..... G03G 15/04
(52) U.S. Cl. ..... 430/65; 399/159
(58) Field of Search ..... 430/65; 399/159

(56) References Cited

FOREIGN PATENT DOCUMENTS

| | | |
|---|---|---|
| JP | A 61-204641 | 9/1986 |
| JP | A 1-113758 | 5/1989 |
| JP | A 3-45961 | 2/1991 |
| JP | A 7-84393 | 3/1995 |
| JP | A 9-96916 | 4/1997 |
| JP | A 9-258469 | 10/1997 |
| JP | A 2001-75296 | 3/2001 |

*Primary Examiner*—Mark A. Chapman
(74) *Attorney, Agent, or Firm*—Oliff & Berridge, PLC

(57) ABSTRACT

An electrophotographic photoreceptor having, between an electroconductive substrate and a photosensitive layer, an interlayer which contains fine metal oxide particles and a binder resin and which, when an electric field of $10^6$ V/m is applied thereto at 28° C. and 85% RH, has a volume resistivity of from $10^8$ to $10^{13}$ Ω·cm and, when an electric field of $10^6$ V/m is applied thereto at 15° C. and 15% RH, has a volume resistivity which is up to 500 times the volume resistivity thereof as measured when an electric field of $10^6$ V/m is applied thereto at 28° C. and 85% RH.

18 Claims, 7 Drawing Sheets

ELECTROPHOTOGRAPHIC PHOTORECEPTOR, PROCESSES FOR PRODUCING THE SAME, PROCESS CARTRIDGE, AND ELECTROPHOTOGRAPHIC APPARATUS

The present disclosure relates to the subject matter contained in Japanese Patent Application No. 2001-311869 filed on Oct. 9, 2001, Japanese Patent Application No. 2002-064162 filed on Mar. 8, 2002, and Japanese Patent Application No. 2002-220100 filed on Jul. 29, 2002, which are incorporated herein by reference in its entirety.

BACKGROUND OF THE INVENTION

1. Field of the Invention

The present invention relates to an electrophotographic photoreceptor, processes for producing the same, a process cartridge, and an electrophotographic apparatus.

2. Description of the Related Art

Electrophotography is utilized in electrophotographic apparatus such as copy duplicator and laser beam printers because it is capable of high-speed high-quality printing. Recently, organic photoreceptors employing a photoconductive organic material have come to be mainly used as photoreceptors for such electrophotographic apparatus. In addition, the constitution of photoreceptors is shifting to the function-separated type in which a charge-generating material and a charge-transporting material are dispersed in separate layers (a charge-generating layer and a charge transport layer).

Many photoreceptors of such function-separated type have an undercoat layer interposed between the substrate and the photosensitive layer so as to prevent charge injection from the substrate into the photosensitive layer or for another purpose. Since properties of the photoreceptor, such as stability to cycling and environmental stability, depend not only on the charge-generating layer and charge transport layer but also on the properties of the undercoat layer, there is a desire for an undercoat layer which attains reduced charge accumulation during repetitions of use. An undercoat layer further plays an important role in preventing image quality defects. It is highly effective to form an undercoat layer in order to diminish image quality defects attributable to defects or fouling of the substrate or to coating film defects or unevenness of an overlying layer, e.g., the charge-generating layer.

In recent years, contact electrification type charging units reduced in ozone generation have come to be used in place of corotrons as the charging units of electrophotographic apparatus. However, when a contact charging unit is used, the photoreceptor is apt to be charged unevenly. Furthermore, in case where the photoreceptor has a local deteriorated area, a local high electric field is applied to the deteriorated area during contact charging to cause an electrostatic pinhole, which tends to result in an image quality defect. Although this pinhole leakage can occur due to coating film defects of the photosensitive layer, it may also occur because electrically conducting paths are apt to be formed by electroconductive foreign particles (e.g., carbon fibers or carrier particles) which have generated within the electrophotographic apparatus and are in contact with the photoreceptor or have penetrated into the photoreceptor.

Under these circumstances, investigations have been made on constituent materials for undercoat layers and properties of the layers so as to avoid those phenomena accompanying the use of a contact charging unit, and electrophotographic photoreceptors having various undercoat layers have been proposed. For example, Japanese Patent Laid-Open No. 204641/1986 discloses an electrophotographic photoreceptor having an undercoat layer which contains a permittivity regulator and thereby has a volume resistivity and a permittivity in respective given ranges. Japanese Patent Laid-Open No. 113758/1989 discloses an organic photoreceptor having an undercoat layer comprising a binder resin, a charge-transporting material, and electroconductive fine particles. Furthermore, Japanese Patent Laid-Open No. 84393/1995 discloses an electrophotographic photoreceptor having an undercoat layer which contains compact particles of fine cicular titanium oxide particles and has a given value of volume resistivity.

However, even with any of those electrophotographic photoreceptors of the related art, it has been extremely difficult to obtain sufficient image quality when they are used together with a contact charging unit. The reasons for this are as follows. From the standpoint of the property of preventing charge leakage due to pinhole generation or the like (hereinafter referred to as "leakage preventive properties"), it is desirable that the thickness of the undercoat layer be large (e.g., about from 10 to 30 $\mu$m). For obtaining sufficient electrical properties, it is necessary to reduce the resistance of the undercoat layer having such an increased thickness. As a result, however, that blocking properties of the undercoat layer by which charge injection from the substrate into the photosensitive layer is prevented become insufficient and fogging is hence apt to occur.

On the other hand, investigations are being made on processes for forming a photoreceptor which comprises an electroconductive support layer (substrate) and formed thereon a layer containing electroconductive fine particles in order to attain stable electrical properties by diminishing the increase in residual potential while hiding the defects of the electroconductive support layer.

An example of such processes is proposed, for example, in Japanese Patent Laid-Open No. 45961/1991. In this process, a photoreceptor having an undercoat layer with a two-layer structure is produced. This process comprises forming a layer containing electroconductive fine particles on an electroconductive support layer, e.g., an aluminum substrate, and further forming a layer having the same constitution as usual undercoat layers on the layer containing electroconductive fine particles. In this process, the layer containing electroconductive fine particles is intended to hide defects, such as surface irregularities and fouling, of the electroconductive support layer and to regulate electrical resistance, while the layer having the same constitution as usual undercoat layers is intended to have a blocking function (inhibition of charge injection).

In another process is produced a photoreceptor having a constitution comprising an electroconductive support layer and formed thereon an undercoat layer which consists only of a layer containing electroconductive fine particles and combines the blocking function and resistance-regulating function. This type of photoreceptor and processes for producing the same are disclosed, for example, in Japanese Patent Laid-Open Nos. 258469/1997, 96916/1997, and 2001-75296.

However, the above-described electrophotographic photoreceptors of the related art are still insufficient in having electrical properties sufficient to enable the photoreceptors to withstand repetitions of use. These electrophotographic photoreceptors have had a problem that when they are repeatedly used, the residual potential increases and this results in fogging such as black spots on the image.

Specifically, the electrophotographic photoreceptor having an undercoat layer of a two-layer structure disclosed in Japanese Patent Laid-Open No. 45961/1991 has had the following problems. It has poor leakage preventive properties and is hence apt to suffer the pinhole leakage described above. Because of this, the photoreceptor comes to have reduced electrification characteristics and causes a decrease in image density with repetitions of use. Another drawback of this photoreceptor is that due to the two-layer structure, the photoreceptor production is troublesome and costly.

The electrophotographic photoreceptors disclosed in Japanese Patent Laid-Open Nos. 258469/1997, 96916/1997, and 2001-75296 are advantageous in that because the undercoat layer has a single-layer structure, the photoreceptor production processes can be simplified and the cost of the photoreceptors can be reduced. However, the necessity of forming a single layer combining a resistance-regulating function and a charge injection-inhibiting function imposes limitations in selecting constituent materials for the undercoat layer.

From the standpoint of preventing pinhole leakage by enhancing the leakage preventive properties of an undercoat layer, it is effective to increase the thickness of the undercoat layer (hereinafter often referred to as thickness increase). In order for an undercoat layer to have an increased thickness, it should have reduced electrical resistance so as to attain satisfactory electrical properties. However, a reduction in electrical resistance impairs the charge-blocking function and this tends to enhance the occurrence of image quality defects such as fogging. Undercoat layers having increased thicknesses further have problems that they are difficult to form and have insufficient mechanical strength. Furthermore, there has been a problem that an increase in undercoat layer thickness may result in a decrease in photoreceptor sensitivity.

Because of those problems, the thicknesses of undercoat layers containing electroconductive metal oxide particles, e.g., titanium oxide particles, have been in the range of about from 0.01 to 20 $\mu$m at the most. For example, in Japanese Patent Laid-Open Nos. 258469/1997, 96916/1997, and 2001-75296, there is a description to the effect that it is undesirable to increase the thickness of the undercoat layer of the electrophotographic photoreceptor disclosed therein beyond 20 $\mu$m for the reasons given above.

SUMMARY OF THE INVENTION

The invention has been achieved in view of the problems of the prior art techniques described above. An aim of the invention is to provide an electrophotographic photoreceptor which combines a high level of leakage preventive properties and a high level of electrical properties and which, even when used together with a contact charging unit, can attain satisfactory image quality without causing image quality defects such as fogging. Another aim of the invention is to provide a process for producing the electrophotographic photoreceptor. Still another aim of the invention is to provide a process cartridge and an electrophotographic apparatus each employing the electrophotographic photoreceptor.

A further aim of the invention is to provide a process for producing an electrophotographic photoreceptor which has high durability capable of sufficiently preventing electrical properties from decreasing with repetitions of use and further has high resolution quality. Still a further aim of the invention is to provide an electrophotographic photoreceptor obtained by the process, a process cartridge, and an electrophotographic apparatus.

The present inventors made intensive investigations in order to accomplish those aims. As a result, it has been found that those aims are accomplished with an electrophotographic photoreceptor comprising an electroconductive substrate, a photosensitive layer, and an interlayer formed therebetween which comprises fine metal oxide particles and a binder resin and has a volume resistivity and environmental dependence of volume resistivity which are within respective specific ranges when determined under given conditions. The invention has been completed based on this finding.

According to the first respect of the invention, an electrophotographic photoreceptor is provided which comprises an electroconductive substrate, an interlayer formed over the substrate, and a photosensitive layer formed over the interlayer, wherein the interlayer comprises fine metal oxide particles and a binder resin and the interlayer, when an electric field of $10^6$ V/m is applied thereto at 28° C. and 85% RH, has a volume resistivity of from $10^8$ to $10^{13}$ Ω·cm and, when an electric field of $10^6$ V/m is applied thereto at 15° C. and 15% RH, has a volume resistivity which is not higher than 500 times of the volume resistivity thereof as measured when an electric field of $10^6$ V/m is applied thereto at 28° C. and 85% RH.

The electrophotographic photoreceptor of the invention has, interposed between the substrate and the photosensitive layer, an interlayer which comprises fine metal oxide particles and a binder resin and satisfies the requirements shown above concerning volume resistivity and its dependence on the environment. Due to this constitution, both of leakage preventive properties and electrical properties are sufficiently enhanced. Consequently, even when the electrophotographic photoreceptor is used together with a contact charging unit, it can attain satisfactory image quality without causing image quality defects such as fogging.

According to the second respect of the invention, a process for producing an electrophotographic photoreceptor is provided which comprises forming an interlayer and a photosensitive layer over an electroconductive substrate, wherein the interlayer, when an electric field of $10^6$ V/m is applied thereto at 28° C. and 85% RH, has a volume resistivity of from $10^8$ to $10^{13}$ Ω·cm and, when an electric field of $10^6$ V/m is applied thereto at 15° C. and 15% RH, has a volume resistivity which is not higher than 500 times of the volume resistivity thereof as measured when an electric field of $10^6$ V/m is applied thereto at 28° C. and 85% RH, the interlayer being obtained by surface treating fine metal oxide particles with at least one coupling agent selected from the group consisting of silane coupling agents, titanate coupling agents, and aluminate coupling agents, heat-treating the surface treated fine metal oxide particles at 180° C. or higher, adding the heat-treated fine metal oxide particles and a binder resin to a given solvent to obtain a coating fluid, applying the coating fluid to an electroconductive substrate, and drying the coating fluid applied.

According to the third respect of the invention, a process for producing an electrophotographic photoreceptor is provided which comprises forming an interlayer and a photosensitive layer over an electroconductive substrate, wherein the interlayer, when an electric field of $10^6$ V/m is applied thereto at 28° C. and 85% RH, has a volume resistivity of from $10^8$ to $10^{13}$ Ω·cm and, when an electric field of $10^6$ V/m is applied thereto at 15° C. and 15% RH, has a volume resistivity which is not higher than 500 times of the volume resistivity thereof as measured when an electric field of $10^6$ V/m is applied thereto at 28° C. and 85% RH, the interlayer being obtained by surface treating fine metal oxide particles with a treating liquid comprising a given solvent and at least one coupling agent selected from the group consisting of silane coupling agents, titanate coupling agents, and aluminate coupling agents, heat-treating the surface treated fine metal oxide particles at a first heat treatment temperature, heat-treating at a second heat treatment temperature the fine metal oxide particles which have been heat-treated at the first heat treatment temperature, adding the fine metal oxide particles heat-treated at the second heat treatment temperature and a binder resin to a given solvent to obtain a coating fluid, applying the coating fluid to an electroconductive substrate, and drying the coating fluid applied.

By each of the processes according to the second and third respects described above, an interlayer satisfying the requirements shown above concerning volume resistivity and its dependence on the environment can be easily formed without fail due to the use of the fine metal oxide particles which have undergone a surface treatment with a given coupling agent and a heat treatment. As a result, the photoreceptor obtained has sufficiently enhanced leakage preventive properties and sufficiently enhanced electrical properties. Consequently, even when the photoreceptor is used together with a contact charging unit, it can attain satisfactory image quality without causing image quality defects such as fogging.

According to the fourth respect of the invention, a process cartridge is provided which comprises an electrophotographic photoreceptor and, united with the photoreceptor, at least one of a charging unit, a development unit, a cleaning unit, an erase unit, and a transfer unit, the electrophotographic photoreceptor comprising an electroconductive substrate, an interlayer formed over the substrate, and a photosensitive layer formed over the interlayer, wherein the interlayer comprises fine metal oxide particles and a binder resin and the interlayer, when an electric field of $10^6$ V/m is applied thereto at 28° C. and 85% RH, has a volume resistivity of from $10^8$ to $10^{13}$ Ω·cm and, when an electric field of $10^6$ V/m is applied thereto at 15° C. and 15% RH, has a volume resistivity which is not higher than 500 times of the volume resistivity thereof as measured when an electric field of $10^6$V/m is applied thereto at 28° C. and 85% RH, the process cartridge being capable of being freely attached to and removed from the main body of an electrophotographic apparatus.

According to the fifth respect of the invention, an electrophotographic apparatus is provided which comprises an electrophotographic photoreceptor, a charging unit which charges the electrophotographic photoreceptor, an exposure unit with which the electrophotographic photoreceptor charged by the charging unit is exposed to light to form an electrostatic latent image, a development unit which develops the electrostatic latent image with a toner to form a toner image, and a transfer unit which transfers the toner image to a receiving medium, the electrophotographic photoreceptor comprising an electroconductive substrate, an interlayer formed over the substrate, and a photosensitive layer formed over the interlayer, wherein the interlayer comprises fine metal oxide particles and a binder resin and the interlayer, when an electric field of $10^6$ V/m is applied thereto at 28° C. and 85% RH, has a volume resistivity of from $10^8$ to $10^{13}$ Ω·cm and, when an electric field of $10^6$ V/m is applied thereto at 15° C. and 15% RH, has a volume resistivity which is not higher than 500 times of the volume resistivity thereof as measured when an electric field of $10^6$ V/m is applied thereto at 28° C. and 85% RH.

The process cartridge and electrophotographic apparatus of the invention each have a contact charging unit. However, the use of this contact charging unit in combination with the electrophotographic photoreceptor of the invention reconciles a high level of leakage preventive properties with a high level of electrical properties. Consequently, the effect that satisfactory image quality is obtained without causing image quality defects such as fogging is produced, although it has been extremely difficult to attain this effect with any of the usual process cartridges and electrophotographic apparatus having a contact charging unit.

DETAILED DESCRIPTION OF THE PREFERRED EMBODIMENTS

Figure 1:
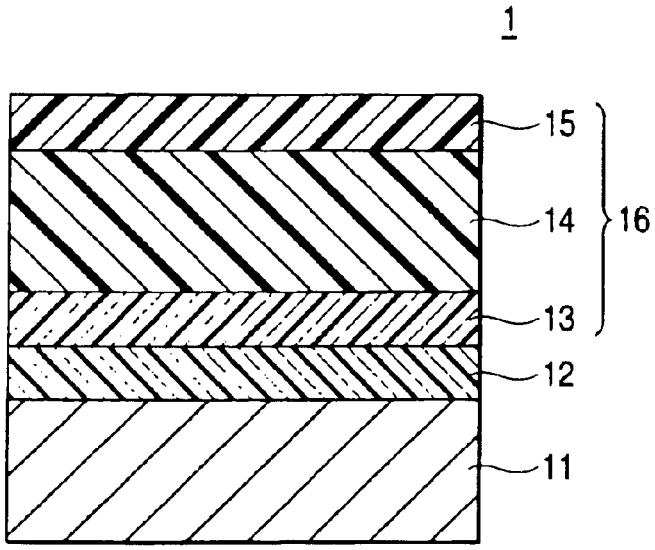
FIG. 1 is a diagrammatic sectional view illustrating an electrophotographic photoreceptor as the first embodiment of the invention.

Preferred embodiments of the invention will be explained below by reference to the accompanying drawings. In the drawings, like or corresponding parts are designated by like numerals. Duplicates of explanation are omitted.

First Embodiment

FIG. 1 is a diagrammatic sectional view illustrating a first embodiment of the electrophotographic photoreceptor of the invention. The electrophotographic photoreceptor 1 shown in FIG. 1 comprises an electroconductive substrate 11, an interlayer 12 formed thereon, and a photosensitive layer 16 formed on the interlayer 12. The photosensitive layer 16 is composed of a charge-generating layer 13, a charge transport layer 14, and a protective layer 15.

The electroconductive substrate 11 is an aluminum substrate formed into a cylindrical shape (drum). Besides aluminum, usable examples of the material of the substrate 11 include metallic materials such as stainless steel and nickel; materials obtained by imparting electrical conductivity to insulating materials such as polymeric materials (e.g., poly(ethylene terephthalate), poly(butylene terephthalate), polypropylene, nylons, polystyrene, and phenolic resins) or rigid papers by dispersing an electroconductive substance (e.g., carbon black, indium oxide, tin oxide, antimony oxide, a metal, or copper iodide) therein; laminates of those insulating materials with a metal foil; and those insulating materials having a metallic coating film formed by vapor deposition. The substrate 11 may be in the form of a sheet, plate, etc.

Examples of the electroconductive substrate 11 include those enumerated hereinabove. Also usable besides these are substrates in a drum, sheet, or plate form produced by imparting electrical conductivity to a polymer sheet, paper, plastic, or glass by vapor-depositing an electroconductive metal compound, e.g., indium oxide or tin oxide, or by laminating a metal foil thereto. Other usable examples include substrates in a drum, sheet, or plate form produced by dispersing a carbon black, indium oxide, tin oxide-antimony oxide powder, metal powder, copper iodide, or the like in a binder resin and applying the dispersion to a polymer sheet, paper, plastic, or glass to thereby impart electrical conductivity thereto.

In the case where a metallic pipe substrate is used as the electroconductive substrate 11, this pipe may be used without any treatment. It is, however, preferred to subject the surface of the pipe beforehand to a treatment such as, e.g., mirror polishing, etching, anodization, rough machining, centerless grinding, sandblasting, wet honing, or coloration. By roughening the substrate surface by a surface treatment, the woodgrain-like streaks which can generate in the photoreceptor when a coherent light such as a laser beam is used can be prevented.

In the case where a metallic pipe is employed as the electroconductive substrate, this pipe may be used without any treatment. Alternatively, the pipe may be subjected beforehand to a treatment such as, e.g., mirror polishing, etching, anodization, rough machining, centerless grinding, sandblasting, or wet honing.

The interlayer 12 is constituted of a material comprising fine metal oxide particles and a binder resin. The interlayer 12 has been regulated so as to have the following resistivity values. When an electric field of $10^6$ V/misapplied to the interlayer 12 at 28° C. and 85% RH, the volume resistivity thereof is from $10^8$ to $10^{13}$ Ω·cm (preferably from $10^8$ to $10^{11}$ Ω·cm). When an electric field of $10^6$ V/m is applied to the interlayer 12 at 15° C. and 15% RH, the volume resistivity thereof is up to 500 times the volume resistivity of the interlayer 12 as measured when an electric field of $10^6$ V/m is applied thereto at 28° C. and 85% RH. By thus regulating the interlayer 12 so as to satisfy those requirements concerning volume resistivity and its dependence on the environment, a high level of leakage preventive properties can be reconciled with a high level of electrical properties.

The interlayer 12 is preferably one which satisfies the following requirement: the volume resistivity thereof as measured in an electric field of $10^6$ V/m at 28° C. and 85% RH is up to 1,000 times the volume resistivity thereof as measured in an electric field of $10^7$ V/m at 28° C. and 85% RH. In case where this volume resistivity ratio exceeds 1,000, leakage is apt to occur when foreign particles have come into the interlayer and a high electrical field is locally applied to the interlayer.

The interlayer 12 can be regulated so as to satisfy the requirements concerning volume resistivity and its dependence on the environment by suitably selecting the kinds and amounts of the fine metal oxide particles and binder resin to be incorporated and by enhancing the dispersibility of the fine metal oxide particles in the binder resin. Preferred examples of the fine metal oxide particles include tin oxide, titanium oxide, zinc oxide, and aluminum oxide.

Those finely particulate metal oxides preferably have a powder resistivity of from $10^2$ to $10^{11}$ Ω·cm (more preferably from $10^4$ to $10^{10}$ Ω·cm). When fine metal oxide particles having a powder resistivity lower than the lower limit are used, sufficient leakage preventive properties tend to be unobtainable. On the other hand, when fine metal oxide particles having a powder resistivity higher than the higher limit are used, an electrophotographic process tends to result in an increase in residual potential.

The fine metal oxide particles preferably have an average primary particle diameter of 100 nm or smaller, more preferably from 10 to 90 nm. Fine metal oxide particles having an average primary particle diameter exceeding 100 nm show poor dispersibility in the binder resin and this tends to result in difficulties in reconciling leakage preventive properties with electrical properties.

Those finely particulate metal oxides can be obtained by production processes heretofore in use. For example, examples of usable processes include: the indirect process (French process), direct process (American process), and wet process described in JIS K1410 for zinc oxide; and the sulfuric acid process, chlorine process, hydrofluoric acid process, titanium chloride potassium process, and aqueous titanium tetrachloride solution process for titanium oxide. Furthermore, the plasma arc process which will be described later can be used for obtaining fine metal oxide particles.

The indirect process comprises heating metallic zinc (usually at about 1,000° C.), oxidizing the resultant zinc vapor with hot air to obtain zinc oxide, and classifying the zinc oxide particles by particle size after cooling. The direct process comprises roasting a zinc ore to obtain zinc oxide, reducing the zinc oxide with, e.g., a coal, and oxidizing the resultant zinc vapor with hot air, or comprises leaching a zinc ore with sulfuric acid, adding coke or the like to the resultant slag, heating the mixture to melt the zinc, and oxidizing the molten zinc with hot air.

In the sulfuric acid process, fine titanium oxide particles are obtained through the steps of preparation of a sulfuric acid salt solution by the reaction of an ore with sulfuric acid, clarification of the solution, precipitation of hydrous titanium oxide by hydrolysis, washing, burning, pulverization, surface treatment, etc. The chlorine process comprises chlorinating an ore to prepare a solution of titanium tetrachloride, obtaining titanium oxide therefrom through rectification and burning, and subjecting the titanium oxide to pulverization and a post-treatment.

Examples of the plasma arc process include the direct-current plasma arc process, plasma jet process, and high-frequency plasma process. For example, the direct-current plasma arc process comprises using a raw metallic material as a consumable anode electrode, causing a cathode electrode to generate a plasma flame to heat and vaporize the raw metallic material, oxidizing the metal vapor, and cooling the oxide to obtain fine metal oxide particles. For generating the plasma flame, an arc discharge is caused in a monoatomic-molecule gas such as, e.g., argon or a diatomic-molecule gas such as, e.g., hydrogen, nitrogen, or oxygen. However, plasmas generated by the thermal dissociation of diatomic molecules are more reactive than plasmas derived from monoatomic-molecule gases (e.g., argon plasma) and are hence called reactive arc plasmas.

In the invention, it is preferred to use fine metal oxide particles obtained by the plasma arc process among the production processes described above. This is because these fine metal oxide particles differ in shape, particle diameter (e.g., 100 nm or smaller), and other properties from fine metal oxide particles obtained by the other processes heretofore in use, and have improved dispersibility and bring about improved photoelectric properties and leakage preventive properties.

There are cases where in producing fine metal oxide particles, for example, by the plasma arc process, fine metal particles come in a minute amount into the fine metal oxide particles. However, this metal oxide may be used without removing the fine metal particles therefrom, as long as the requirements concerning the volume resistivity of the interlayer and its dependence on the environment are satisfied.

The fine metal oxide particles are preferably subjected to a surface treatment with at least one coupling agent selected from the group consisting of silane coupling agents, titanate coupling agents, and aluminate coupling agents and then to a heat treatment at 180° C. or higher. An example of the surface treatment is a coating treatment. When fine metal oxide particles which have undergone the coating treatment with a coupling agent and the heat treatment are used, the volume resistivity of the interlayer and the dependence of the volume resistivity on the environment can be easily regulated without fail because these fine metal oxide particles have enhanced dispersibility in the binder resin. As a result, both leakage preventive properties and electrical properties can be improved further.

Examples of the silane coupling agents usable in the invention include vinyltrimethoxysilane, γ-methacryloxypropyltris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Examples of the titanate coupling agents include isopropyl triisostearoyl titanate, bis(dioctylpyrophosphate), and isopropyl tri(N-aminoethylaminoethyl) titanate. Examples of the aluminate coupling agents include acetoalkoxyaluminum diisopropylates. These may be used alone or in combination of two or more thereof. Preferred of these are the coupling agents having one or more amino groups, such as γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and isopropyl tri(N-aminoethylaminoethyl) titanate, because the coating treatment with these coupling agents can be efficiently conducted without fail. It is especially preferred to use a coupling agent having two amino groups, such as N-β-(aminoethyl)-γ-aminopropyltrimethoxysilane or N-β-(aminoethyl)-γ-aminopropylmethylmethoxysilane.

The coating treatment with any of those coupling agents can be accomplished by dissolving the coupling agent in a solvent which undergoes substantially no reaction with the coupling agent and dispersing the fine metal oxide particles in this solution (treating liquid). Examples of the solvent include toluene, ethylbenzene, tetrahydrofuran, ethyl acetate, butyl acetate, methylene chloride, chloroform, chlorobenzene, acetone, and methyl ethyl ketone. However, it is preferred to use a high-boiling solvent, e.g., toluene, among these solvents. For dispersing the coupling agent in the solvent in preparing the treating liquid, use may be made of stirring, ultrasonic, or a device such as a sand grinder-mill, attritor, or ball mill. The treatment can be conducted at any temperature between room temperature and the boiling point of the solvent.

The amount of the solvent to be used relative to the amount of the fine metal oxide particles can be determined at will. However, the proportion by weight of the fine metal oxide particles to the solvent is preferably from 1:1 to 1:10, more preferably from 1:2 to 1:4. When the weight of the solvent is smaller than that of the fine metal oxide particles, stirring is difficult and gelation may occur. Namely, even treatment tends to be difficult. On the other hand, in case where the weight of the solvent is more than ten times the weight of the fine metal oxide particles, part of the coupling agent tends to remain unreacted. The amount of the coupling agent to be used is preferably up to 10% by weight, more preferably from 0.1 to 5.0% by weight, based on the fine metal oxide particles from the standpoints of electrical properties, image quality retention, film-forming properties, etc.

This coating treatment is conducted with stirring. For more evenly coating the particles with the coupling agent, it is preferred to use a dispersing medium such as, e.g., silica gel, alumina, or zirconia (preferably one having a diameter of from 0.5 to 50 mm). In the case where solvent removal from the mixture which has undergone the coating treatment results in agglomeration of the fine metal oxide particles, it is preferred to pulverize the agglomerates before a heat treatment. For rapidly removing the solvent after the coating treatment, it is preferred to conduct distillation under given pressure conditions (preferably from 0.1 to 760 mmHg). Although filtration may be used for removing the solvent, use of filtration is undesirable in that the coupling agent which has not reacted is apt to effuse and it is difficult to regulate the amount of the coupling agent to a value necessary for obtaining desired properties.

After the coating treatment, the fine metal oxide particles preferably have a surface coverage of from 7 to 20%. In case where the surface coverage thereof is lower than the lower limit, the fine metal oxide particles cannot have a sufficiently increased resistivity and this tends to result in an interlayer having reduced blocking properties and hence in impaired image quality. In case where the surface coverage thereof exceeds the upper limit, the residual potential of the electrophotographic photoreceptor is apt to increase with repetitions of use and fluctuations of the volume resistivity in the environment tend to become large. The term surface coverage used herein means the proportion [%] of that surface of the fine metal oxide particles which has been covered with the coupling agent. This proportion is determined from the BET specific surface area of the fine metal oxide particles as measured before the coating treatment and the amount of the coupling agent incorporated. Namely, the weight of the coupling agent necessary for a surface coverage of 100% is given by the following equation:

(Weight [g] of coupling agent necessary for surface coverage of 100%)={(weight [g] of fine metal oxide particles)×(BET specific surface are [$m^2/g$] of the metal oxide)}/(minimum area of coverage with coupling agent [$m^2/g$])

(wherein the "minimum area of coverage with coupling agent" means the minimum area which can be covered with 1 g of the coupling agent in the form of a monomolecular film). The surface coverage can be determined using the following equation.

(Surface coverage [%])=100×(weight [g] of coupling agent used for coating treatment)/(weight [g] of coupling agent necessary for surface coverage of 100%)

The fine metal oxide particles which have undergone the coating treatment described above are subjected to a given heat treatment, whereby a more complete coating film can be formed through a reaction of the coupling agent. The temperature for this heat treatment is preferably 180° C. or higher as stated above, and is more preferably from 200 to 300° C., most preferably from 200 to 250° C. In case where the heat treatment temperature is lower than 180° C., the residual adsorbed water and coupling agent are not sufficiently removed and electrical properties such as dark decay tend to become insufficient. In case where the heat treatment temperature exceeds 300° C., decomposition of the coating film formed from the coupling agent and oxidation of the surface of the fine metal oxide particles may occur to yield charge-trapping sites and this tends to result in an increase in residual potential. Although the time period of this heat treatment is suitably selected according to the kind of the coupling agent and heat treatment temperature, it is generally about from 10 minutes to 100 hours.

The heat treatment of the fine metal oxide particles which have undergone the coating treatment is preferably conducted by heating the particles in two steps at different temperatures. In this treatment, the first-step heating is preferably conducted at a temperature not lower than the boiling point of the treating liquid, while the second-step heating is preferably conducted at a temperature of 180° C. or higher (more preferably from 200 to 300° C., most preferably from 200 to 250° C.)

Examples of the binder resin contained in the interlayer 12 include polymeric resin compounds such as acetal resins, e.g., poly(vinyl butyral), poly(vinyl alcohol) resins, casein, polyamide resins, cellulosic resins, gelatins, polyurethane resins, polyester resins, methacrylic resins, acrylic resins, poly(vinyl chloride) resins, poly(vinyl acetate) resins, vinyl chloride/vinyl acetate/maleic anhydride resins, silicone resins, silicone-alkyd resins, phenolic resins, phenol-formaldehyde resins, melamine resins, and urethane resins. Examples thereof further include charge-transporting resins having charge-transporting groups and electroconductive resins such as polyaniline.

Preferred of those are the resins which are insoluble in the solvent to be used for forming the overlying layer. Especially preferred are phenolic resins, phenol-formaldehyde resins, melamine resins, urethane resins, and epoxy resins. The coated fine metal oxide particles and the binder resin can be used in any desired proportion as long as the electrophotographic photoreceptor has the desired properties.

The interlayer 12 may consist of the coated fine metal oxide particles and the binder resin only. However, it may contain additives for improving electrical properties, environmental stability, or image quality as long as the requirements concerning volume resistivity and its dependence on the environment are satisfied. Examples of such additives include electron-transporting substances such as quinone compounds, e.g., chloranilquinone, bromoanilquinone, and anthraquinone, tetracyanoquinodimethane compounds, fluorenone compounds, e.g., 2,4,7-trinitrofluorenone and 2,4,5,7-tetranitro-9-fluorenone, oxadiazole compounds, e.g., 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone compounds, thiophene compounds, and diphenoquinone compounds, e.g., 3,3',5,5'-tetra-t-butyldiphenoquinone, electron-transporting pigments such as polycyclic condensation pigments and azo pigments, silane coupling agents, zirconium chelate compounds, titanium chelate compounds, aluminum chelate compounds, titanium alkoxide compounds, and organotitanium compounds.

Examples of the silane coupling agents include vinyltrimethoxysilane, γ-methacryloxypropyltris(β-methoxyethoxy)silane, β-(3,4-epoxycyclohexyl) ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N,-bis(β-hydroxyethyl)-γ-aminopropyltriethoxysilane, and γ-chloropropyltrimethoxysilane.

Examples of the zirconium chelate compounds include zirconium butoxide, zirconium ethyl acetoacetate, zirconium triethanolamine, acetylacetonatozirconium butoxide, (ethyl acetoacetate) zirconium butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide.

Examples of the titanium chelate compounds include tetraisopropyl titanate, tetra-n-butyl titanate, butyl titanate dimer, tetra(2-ethylhexyl) titanate, titanium acetylacetonate, poly(titanium acetylacetonate), titanium octylene glycolate, titanium lactate ammonium salt, titanium lactate, titanium lactate ethyl ester, triethanolamine titanate, and polyhydroxytitanium stearate.

Examples of the aluminum chelate compounds include aluminum isopropylate, monobutoxyaluminum diisopropylate, aluminum butylate, diethylacetoacetatoaluminum diisopropylate, and aluminum tris (ethylacetoacetate). These compounds may be used alone or as a mixture or polycondensate of two or more thereof.

The interlayer 12 can be formed, for example, by dispersing/dissolving the coated fine metal oxide particles and the binder resin in a given solvent to prepare a coating fluid for interlayer formation, applying this coating fluid to the electroconductive substrate 11, and drying the coating. For dispersing/dissolving the particles and the resin in preparing the coating fluid, use can be made of a ball mill, roll mill, sand grinder-mill, attritor, ultrasonic, or the like. Examples of coating techniques usable for applying the coating fluid include blade coating, mayer bar coating, spray coating, dip coating, bead coating, air knife coating, and curtain coating. A slight amount of a silicone oil may be added as a leveling agent to the coating fluid for the purpose of improving the surface smoothness of the coating film to be formed.

The thickness of the interlayer 12 thus obtained is preferably from 3 to 50 μm, more preferably from 15 to 50 μm, most preferably from 15 to 30 μm. In case where the thickness of the interlayer is smaller than 3 μm, sufficient leakage preventive properties tend to be unobtainable. As the thickness of the interlayer increases, leakage preventive properties improve. However, interlayers having a thickness exceeding 50 μm are difficult to form and tend to result in impaired image quality due to an increase in residual potential. The interlayer 12 preferably has a Vickers strength of 35 or higher.

The charge-generating layer 13 comprises a charge-generating material and optionally contains a binder resin. The charge-generating material is not particularly limited, but is preferably a phthalocyanine pigment. By using a phthalocyanine pigment, an electrophotographic photoreceptor having high sensitivity and excellent stability to cycling can be obtained. Although phthalocyanine pigments exist in several crystal forms, the phthalocyanine pigment to be used is not particularly limited in crystal form as long as it enables the photoreceptor to have sensitivity suitable for the intended purpose. Especially preferred examples of the charge-generating material are shown below.

In the case where the photoreceptor is of the type which utilizes an infrared light, examples of usable pigments include phthalocyanine pigments, squarylium pigments, bisazo pigments, trisazo pigments, perylene pigments, and dithioketopyrrolopyrrole pigments. In the case where the photoreceptor is of the type which utilizes a visible laser light, examples of usable pigments include polycyclic condensation pigments, bisazo pigments, perylene pigments, trigonal selenium, and dye-sensitized metal oxides.

Preferred of the pigments enumerated above are phthalocyanine pigments because they can give excellent images. Use of a phthalocyanine pigment facilitates the production of an electrophotographic photoreceptor which has especially high sensitivity and can maintain satisfactory image quality even in repetitions of use.

Phthalocyanine pigments generally exist in several crystal forms, and a phthalocyanine pigment in any of these crystals forms can be used as long as this crystal form gives sensitivity suitable for the intended purpose. Especially preferably used of the phthalocyanine pigments are the phthalocyanine pigments represented by the following formulae (1) to (6).

(1)

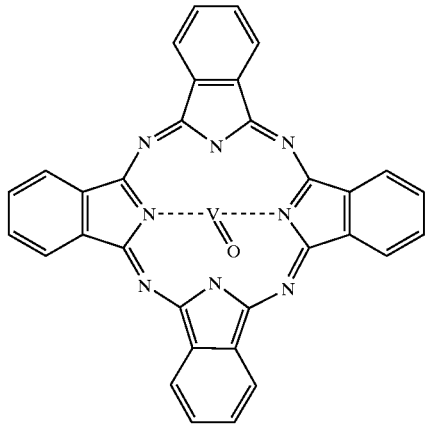

(2)

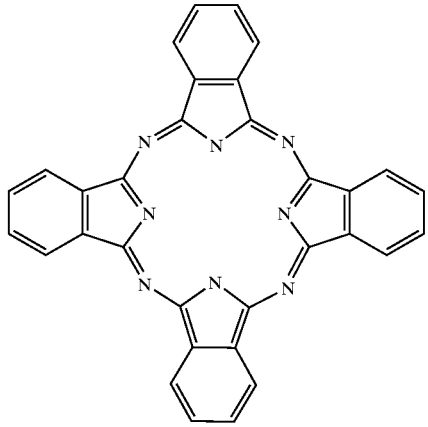

(3)

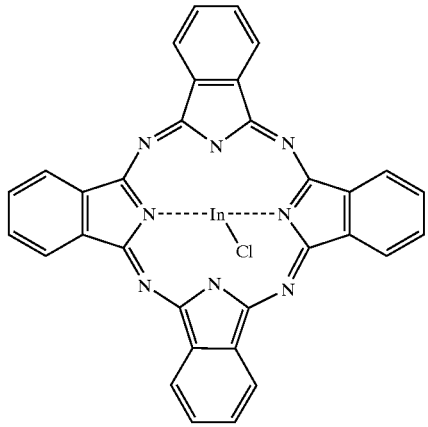

(4)

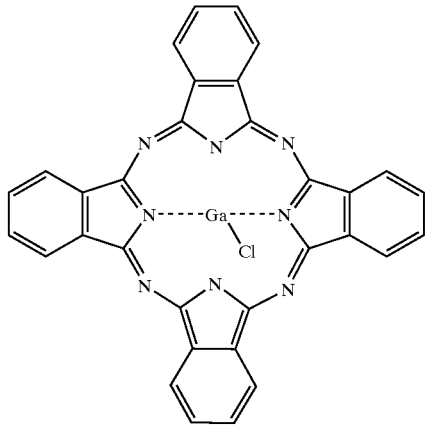

-continued (5)

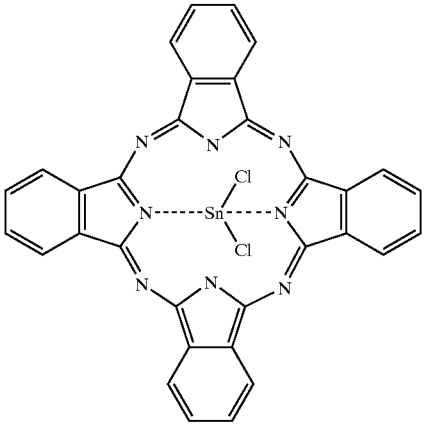

(6)

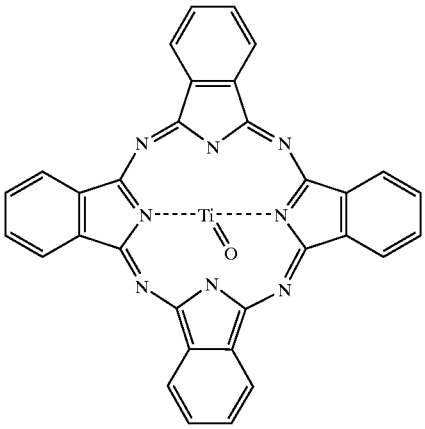

Of the phthalocyanine pigments represented by formulae (1) to (6), the chlorogallium phthalocyanine is preferably one which, when examined by X-ray diffractometry with a CuKα ray, gives a diffraction spectrum having diffraction peaks at least at Bragg angles (2θ±0.2°) of 7.4°, 16.6°, 25.5°, and 28.3°. The titanyl phthalocyanine is preferably one which, when examined by X-ray diffractometry with a CuKα ray, gives a diffraction spectrum having diffraction peaks at least at Bragg angles (2θ+0.2°) of 9.6°, 24.1°, and 27.3° and the maximum peak at 27.3°.

Preferred besides the phthalocyanine pigments shown by formulae (1) to (6) is hydroxygallium phthalocyanine, which has the structure formed by replacing the chlorine atom bonded to the gallium atom serving as the coordination center in formula (4) with an —OH group. This hydroxygallium phthalocyanine is preferably one which, when examined by X-ray diffractometry with a CuKα ray, gives a diffraction pattern having diffraction peaks at least at Bragg angles (2θ±0.2°) of 7.5°, 9.9°, 12.5°, 16.3°, 18.6°, 25.1°, and 28.1°.

Preferred charge-generating materials for use in the invention can be produced by subjecting pigment crystals produced by a known method to mechanical dry pulverization with an automatic triturator, planetary mill, vibrating mill, centrifugal-mill, roll-mill, sand grinder-mill, kneader, or the like, or by subjecting the pigment crystals to the dry pulverization and then to wet pulverization together with a solvent with a ball mill, mortar, sand grinder-mill, kneader, or the like.

Examples of the solvent to be used in the wet pulverization include aromatics (e.g., toluene and chlorobenzene), amides (e.g., dimethylformamide and N-methylpyrrolidone), aliphatic alcohols (e.g., methanol, ethanol, and butanol), aliphatic polyhydric alcohols (e.g., ethylene glycol, glycerol, and polyethylene glycol), aromatic alcohols (e.g., benzyl alcohol and phenethyl alcohol), esters (e.g., ethyl acetate and butyl acetate), ketones (e.g., acetone and methyl ethyl ketone), dimethyl sulfoxide, ethers (e.g., diethyl ether and tetrahydrofuran), mixtures of two or more of these, and mixtures of water and one or more of these organic solvents. The amount of the solvent to be used is desirably from 1 to 200 parts by weight, preferably from 10 to 100 parts by weight, per part by weight of the pigment crystals. The temperature for the wet pulverization is desirably from 0° C. to the boiling point of the solvent, preferably from 10 to 60° C. An abrasion aid such as common salt or Glauber's salt may be used in the pulverization. The amount of the abrasion aid to be used may be generally from 0.5 to 20 times by weight, preferably from 1 to 10 times by weight, the amount of the pigment.

It is also possible to subject pigment crystals produced by a known method to acid pasting or to a combination of acid pasting and the dry pulverization or wet pulverization described above to thereby regulate the crystals. The acid to be used for the acid pasting preferably is sulfuric acid having a concentration of generally from 70 to 100%, preferably from 95 to 100%. The amount of such concentrated sulfuric acid is generally from 1 to 100 times by weight, preferably from 3 to 50 times by weight, the amount of the pigment crystals. The crystals are dissolved at a temperature of generally from −20 to 100° C., preferably from 0 to 60° C. For precipitating crystals from the acid, a solvent is used. Water or a mixture of water and an organic solvent may be used as the solvent in any desired amount. Although the temperature at which crystals are precipitated is not particularly limited, it is preferred to cool the system with ice or another means in order to prevent heat generation.

Those charge-generating materials may be coated with an organometallic compound or silane coupling agent each having one or more hydrolyzable groups. This coating is effective in improving the dispersibility of the charge-generating materials and improving the applicability of the coating fluid for forming a charge-generating layer, whereby a charge-generating layer having a smooth surface and high evenness of dispersion can be easily formed without fail. As a result, image quality defects such as blurring and ghosts can be prevented and image quality retention can be improved. Furthermore, since the coating fluid for forming a charge-generating layer is greatly improved in storage stability, the coating treatment is effective also in prolonging the pot life and contributes to a reduction in photoreceptor cost.

The organometallic compound or silane coupling agent each having one or more hydrolyzable groups is a compound represented by the following general formula (1):

$$R_p—M—Y_q \quad (1)$$

(wherein R represents an organic group; M represents either an atom of a metal other than the alkali metals or a silicon atom; Y represents a hydrolyzable group; and p and q each are an integer of 1 to 4, provided that the sum of p and q corresponds to the valence of M).

In general formula (1), examples of the organic group represented by R include alkyl groups such as methyl, ethyl, propyl, butyl, and octyl, alkenyl groups such as vinyl and allyl, cycloalkyl groups such as cyclohexyl, aryl groups such as phenyl and naphthyl, alkaryl groups such as tolyl, arylalkyl groups such as benzyl and phenylethyl, arylalkenyl groups such as styryl, and heterocyclic groups such as furyl, thienyl, pyrrolidinyl, pyridyl, and imidazolyl. These organic groups may have one or more of various substituents.

Examples of the hydrolyzable group represented by Y in general formula (1) include ether groups such as methoxy, ethoxy, propoxy, butoxy, cyclohexyloxy, phenoxy, and benzyloxy, ester groups such as acetoxy, propionyloxy, acryloyloxy, methacryloyloxy, benzoyloxy, methanesulfonyloxy, benzenesulfonyloxy, and benzyloxycarbonyl, and halogen atoms such as chlorine.

In general formula (1), M is not particularly limited as long as it is either an atom of a metal other than the alkali metals or a silicon atom. However, M is preferably a titanium atom, aluminum atom, zirconium atom, or silicon atom. Namely, an organotitanium compound, organoaluminum compound, organozirconium compound, or silane coupling agent each substituted with one or more of those organic groups and one or more of those hydrolyzable groups is preferably used in the invention.

Examples of the silane coupling agent include vinyltrimethoxysilane, γ-methacryloxypropyltris(β-methoxyethoxy)silane, β-(3,4-epoxycyclohexyl) ethyltrimethoxysilane, γ-glycidoxypropyltrimethoxysilane, vinyltriacetoxysilane, γ-mercaptopropyltrimethoxysilane, γ-aminopropyltriethoxysialne, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Preferred of these are vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl)ethyltrimethoxysilane, N-2-(aminoethyl)-3-aminopropyltrimethoxysilane, N-2-(aminoethyl)-3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane.

Hydrolyzates of the organometallic compounds and silane coupling agents shown above are also usable. Examples of the hydrolyzates include those formed by hydrolyzing Y (a hydrolyzable group) bonded to M (an atom of a metal other than the alkali metals or a silicon atom) of organic compounds represented by the general formula or by hydrolyzing a hydrolyzable group bonded as a substituent to R (an organic group) of the organic compounds. In the case where the organometallic compounds and silane coupling agents contain two or more hydrolyzable groups, all these functional groups need not be hydrolyzed, and products obtained by partly hydrolyzing the hydrolyzable groups may be used. Those organometallic compounds and silane coupling agents may be used alone or in combination of two or more thereof.

Examples of techniques for coating a phthalocyanine pigment with an organometallic compound and/or silane coupling agent each having one or more hydrolyzable groups (hereinafter referred to simply as "organometallic compound") include: a method in which the phthalocyanine pigment is coated in the step of regulating crystals of the phthalocyanine pigment; a method in which the phthalocyanine pigment is coated before being dispersed in a binder resin; a method in which the phthalocyanine pigment is mixed with the organometallic compound when dispersed in a binder resin; and a method in which after the phthalocyanine pigment is dispersed in a binder resin, the organometallic compound is added thereto and the pigment is further dispersed.

More specifically, examples of the method in which the phthalocyanine pigment is coated beforehand in the step of regulating crystals of the phthalocyanine pigment include: a method which comprises mixing the organometallic compound with the phthalocyanine pigment whose crystals have not been regulated and then heating the mixture; a method which comprises mixing the organometallic compound with the phthalocyanine pigment whose crystals have not been regulated and then subjecting the mixture to mechanical dry pulverization; and a method which comprises mixing a liquid mixture of the organometallic compound and either water or an organic solvent with the phthalocyanine pigment whose crystals have not been regulated and subjecting the resultant mixture to wet pulverization.

Examples of the method in which the phthalocyanine pigment is coated before being dispersed in a binder resin include: a method which comprises mixing the organometallic compound with water or a water/organic solvent mixture and with the phthalocyanine pigment and heating the resultant mixture; a method which comprises directly spraying the organometallic compound over the phthalocyanine pigment; and a method which comprises mixing the organometallic compound with the phthalocyanine pigment and milling the mixture.

Examples of the method in which the phthalocyanine pigment is mixed with the organometallic compound during dispersion include: a method which comprises successively adding the organometallic compound, the phthalocyanine pigment, and a binder resin to a solvent as a dispersion medium and mixing the ingredients simultaneously with the addition; and a method which comprises simultaneously adding these ingredients for forming a charging-generating layer and mixing the ingredients.

Examples of the method in which after the phthalocyanine pigment is dispersed in a binder resin, the organometallic compound is added thereto and the pigment is further dispersed include a method which comprises adding the organometallic compound diluted with a solvent to the dispersion and stirring the mixture to disperse the ingredients. In this dispersion treatment, an acid such as, e.g., sulfuric acid, hydrochloric acid, or trifluoroacetic acid may be added as a catalyst in order to more tenaciously adhere the organometallic compound to the phthalocyanine pigment.

Preferred of those are the method in which the phthalocyanine pigment is coated beforehand in the step of regulating crystals of the phthalocyanine pigment and the method in which the phthalocyanine pigment is coated before being dispersed in a binder resin.

The binder resin to be used in the charge-generating layer 13 can be selected from a wide range of insulating resins. It can be selected also from organic photoconductive polymers such as poly(N-vinylcarbazole), polyvinylanthracene, polyvinylpyrene, and polysilanes. Preferred examples of the binder resin include insulating resins such as poly(vinyl acetal) resins, polyarylate resins (e.g., polycondensates of bisphenol A with phthalic acid), polycarbonate resins, polyester resins, phenoxy resins, vinyl chloride/vinyl acetate copolymers, polyamide resins, acrylic resins, polyacrylamide resins, polyvinylpyridine resins, cellulosic resins, urethane resins, epoxy resins, casein, poly(vinyl alcohol) resins, and polyvinylpyrrolidone resins. Especially preferred of these are poly(vinyl acetal) resins and vinyl chloride-vinyl acetate copolymer. These binder resins may be used alone or in combination of two or more thereof. In the charge-generating layer 13, the proportion (weight ratio) of the charge-generating material to the binder resin is preferably in the range of from 10:1 to 1:10. In case where the weight of the pigment relative to the binder resin weight is below the lower limit of that proportion range, troubles such as impaired film-forming properties are more apt to arise. On the other hand, in case where the weight of the pigment relative to the binder resin weight exceeds the upper limit of that proportion range, sufficient sensitivity is more apt to be unobtainable because the resin content in the film is relatively low.

The content of the pigment is preferably from 10 to 90% by weight, more preferably from 40 to 70% by weight, based on the total amount of the charge-generating layer 13. In case where the content of the pigment is lower than the lower limit of the range shown above, sufficient sensitivity is difficult to obtain. On the other hand, when the content of the pigment exceeds the upper limit of that range, troubles such as a decrease in electrification characteristics and a decrease in sensitivity are more apt to arise.

The charge-generating layer 13 is formed by the vapor deposition of a charge-generating material or by applying a coating fluid containing a charge-generating material and a binder resin. The solvent to be used for preparing the coating fluid is not particularly limited as long as the binder resin can be dissolved therein and the solvent does not influence to change crystal form of the pigment (charge production material) Known organic solvent maybe used as the solvent. For example, it can be selected at will from alcohols, aromatic compounds, halogenated hydrocarbons, ketones, ketone alcohols, ethers, esters, and the like. Specific examples of the solvent include methanol, ethanol, n-propanol, isopropanol, n-butanol, benzyl alcohol, methyl Cellosolve, ethyl Cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene. These solvents may be used alone or as a mixture of two or more thereof.

For dispersing or dissolving the charge-generating material and the binder resin in a solvent, use can be made of a roll mill, ball mill, vibration ball-mill, attritor, sand grinder-mill, colloid mill, paint shaker, or the like. It is effective to conduct this dispersion to such a degree that the charge-generating material comes to have a particle size of 0.5 μm or smaller, preferably 0.3 μm or smaller, more preferably 0.15 μm or smaller. For the purpose of improving electrical properties, image quality, etc., the additives shown above in the explanation of the interlayer 12 can be incorporated into this coating fluid for forming a charge-generating layer. Examples of coating techniques usable for applying the coating fluid include blade coating, wire-wound bar coating, spray coating, dip coating, bead coating, air knife coating, and curtain coating. A slight amount of a silicone oil maybe added as a leveling agent to the coating fluid for the purpose of improving the surface smoothness of the coating film to be formed. The thickness of the charge-generating layer 13 thus obtained is preferably from 0.05 to 5 μm, more preferably from 0.1 to 2.0 μm, further more preferably from 0.1 to 1.0 μm. In case where the thickness of the charge-generating layer 13 is smaller than 0.05 μm, sufficient sensitivity cannot be imparted. On the other hand, when the thickness of the charge-generating layer 13 exceeds 5 μm, troubles such as poor electrification characteristics are apt to arise.

The charge transport layer 14 comprises a charge-transporting material and a binder resin. Examples of the charge-transporting material include hole-transporting substances such as oxadiazole derivatives, e.g., 2,5-bis(p-diethylaminophenyl)-1,3,4-oxadiazole, pyrazoline derivatives, e.g., 1,3,5-triphenylpyrazoline and 1-[pyridyl-(2)-]-3-(p-diethylaminostyryl)-5-(p-diethylaminostyryl) pyrazoline, aromatic tertiary amino compounds, e.g., triphenylamine, tri(p-methyl)phenylamine, N,N'-bis(3,4-dimethylphenyl)biphenyl-4-amine, dibenzylaniline, and 9,9-dimethyl-N,N'-di(p-tolyl)fluorenon-2-amine, aromatic tertiary diamino compounds, e.g., N,N'-diphenyl-N,N'-bis (3-methylphenyl)-[1,1-biphenyl]-4,4'-diamine, 1,2,4-triazine derivatives, e.g., 3-(4'-dimethylaminophenyl)-5,6-di (4'-methoxyphenyl)-1,2,4-triazine, hydrazone derivatives, e.g., 4-diethylaminobenzaldehyde-1,1-diphenylhydrazone, 4-diphenylaminobenzaldehyde-1,1-diphenylhydrazone, and [p-(diethylamino)phenyl](1-naphthyl)phenylhydrazone, quinazoline derivatives, e.g., 2-phenyl-4-styrylquinazoline, benzofuran derivatives, e.g., 6-hydroxy-2,3-di(p-methoxyphenyl)benzofuran, α-stilbene derivatives, e.g., p-(2,2-diphenylvinyl)-N,N'-diphenylaniline, enamine derivatives, carbazole derivatives, e.g., N-ethylcarbazole, and poly(N-vinylcarbazole) and derivatives thereof; electron-transporting substances such as quinone compounds, e.g., chloranilquinone, bromoanilquinone, and anthraquinone, tetracyanoquinodimethane compounds, fluorenone compounds, e.g., 2,4,7-trinitrofluorenone and 2,4,5,7-tetranitro-9-fluorenone, oxadiazole compounds, e.g., 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole, xanthone compounds, thiophene compounds, and diphenoquinone compounds, e.g., 3,3',5,5'-tetra-t-butyldiphenoquinone; and polymers having in the main chain or a side chain thereof a residue formed by removing, e.g., one or more hydrogen atoms from any of the compounds enumerated above. These charge-transporting materials may be used alone or in combination of two or more thereof.

The binder resin contained in the charge transport layer 14 is not particularly limited. However, it is preferably an electrically insulating resin capable of forming a film. Examples of such binder resins include polycarbonate resins, polyester resins, methacrylic resins, acrylic resins, poly (vinyl chloride) resins, poly(vinylidene chloride) resins, polystyrene resins, poly(vinyl acetate) resins, styrene/butadiene copolymers, vinylidene chloride/acrylonitrile copolymers, vinyl chloride/vinyl acetate copolymers, vinyl chloride/vinyl acetate/maleic anhydride copolymers, silicone resins, silicone-alkyd resins, phenol-formaldehyde resins, styrene-alkyd resins, poly(N-vinylcarbazole), poly(vinyl butyral), poly(vinyl formal), polysulfones, casein, gelatins, poly(vinyl alcohol), ethyl cellulose, phenolic resins, polyamides, carboxymethyl cellulose, vinylidene chloride-based polymer waxes, and polyurethanes. Preferred of these are polycarbonate resins, polyester resins, methacrylic resins, and acrylic resins because they are superior in compatibility with charge-transporting materials, solubility in solvents, and strength. Those binder resins may be used alone or in combination of two or more thereof.

As a condition for adding dispersion particles such as pigment to the charge transport layer 14, the particle diameter of the particles, e.g., the charge-transporting material, dispersedly contained in the coating fluid for forming the charge transport layer 14 is preferably 0.5 μm or smaller, more preferably 0.3 μm or smaller, most preferably 0.15 μm or smaller. In case where the particle diameter of the dispersed particles exceeds 0.5 μm, the coating fluid shows poor film-forming properties in the formation of the charge transport layer 14 and this tends to result in image quality defects.

The charge transport layer 14 can be formed from a coating fluid prepared by dispersing/dissolving the charge-transporting material and the binder resin in a given solvent. Although the solvents shown above in the explanation of the coating fluid for the charge-generating layer 13 can be used for this coating fluid, it is preferred to select a solvent in which the binder resin of the charge-generating layer 13 is poorly soluble. The proportion (weight ratio) of the charge-transporting material to the binder resin is preferably from 3:7 to 6:4. In case where the proportion thereof is outside the range, at least one of electrical properties and film strength tends to decrease. A slight amount of a silicone oil may be added as a leveling agent to the coating fluid for the purpose of improving the surface smoothness of the coating film to be formed. For dispersing the charge-transporting material in preparing the coating fluid and for applying the coating fluid, the same techniques as in the case of the charge-generating layer 13 can be used. The thickness of the charge transport layer 14 thus obtained is desirably from 5 to 50 $\mu$m, preferably from 10 to 35 $\mu$m.

The protective layer 15 serves to prevent the charge transport layer 14 or another layer from undergoing a chemical change during a charging step or to further enhance the mechanical strength of the photosensitive layer 16. The protective layer 15 is constituted of an appropriate binder resin and an electroconductive material contained therein. Examples of the electroconductive material include metallocene compounds such as N,N'-dimethylferrocene, aromatic amine compounds such as N,N'-diphenyl-N,N'-bis(3-methylphenyl)-1,1'-biphenyl-4,4'-diamine, molybdenum oxide, tungsten oxide, antimony oxide, tin oxide, titanium oxide, indium oxide, solid solutions between tin oxide and antimony or antimony oxide, mixtures of two or more of these, and particulate materials in which each particle contains or is coated with any of those metal oxides.

Examples of the binder resin contained in the protective layer 15 include polyamide resins, poly(vinyl acetal) resins, polyurethane resins, polyester resins, epoxy resins, polyketone resins, polycarbonate resins, poly(vinyl ketone) resins, polystyrene resins, polyacrylamide resins, polyimide resins, and poly(amide-imide) resins. These resins may be crosslinked before use according to need.

The protective layer 15 can be formed from a coating fluid prepared by dispersing/dissolving the electroconductive material and the binder resin in a given solvent, in the same manner as for the charge-generating layer 13, etc. The solvent to be used for preparing the coating fluid is preferably one in which the binder resin of the underlying layer (charge transport layer 14 in the case of the photoreceptor shown in FIG. 1) has the lowest possible solubility. The thickness of the protective layer 15 is desirably from 1 to 20 $\mu$m, preferably from 2 to 10 $\mu$m.

For applying the coating fluid for forming the protective layer 15, an ordinary technique can be used such as, e.g., blade coating, wire-wound bar coating, spray coating, dip coating, bead coating, air knife coating, or curtain coating.

Examples of the solvent to be used for preparing the coating fluid for forming the protective layer 15 include ordinary organic solvents such as dioxane, tetrahydrofuran, methylene chloride, chloroform, chlorobenzene, and toluene. These may be used alone or as a mixture of two or more thereof. However, it is preferred to use a solvent in which the photosensitive layer 16 to be coated with this coating fluid has the lowest possible solubility.

Additives such as an antioxidant, light stabilizer, and heat stabilizer may be added to the photosensitive layer 16 (charge-generating layer 13, charge transport layer 14, etc.) for the purpose of preventing the photoreceptor from being deteriorated by the ozone or oxidizing gas which has generated in the electrophotographic apparatus or by light or heat.

Examples of the antioxidant include hindered phenols, hindered amines, p-phenylenediamine, arylalkanes, hydroquinone, spirocoumarone, spiroindanone, derivatives of these, organosulfur compounds, and organophosphorus compounds.

More specifically, examples of the phenolic antioxidants include 2,6-di-t-butyl-4-methylphenol, styrenated phenols, n-octadecyl 3-(3',5'-di-t-butyl-4'-hydroxyphenyl) propionate, 2,2'-methylenebis(4-methyl-6-t-butylphenol), 2-t-butyl-6-(3'-t-butyl-5'-methyl-2'-hydroxybenzyl)-4-methylphenyl acrylate, 4,4'-butylidenebis(3-methyl-6-t-butylphenol), 4,4'-thiobis(3-methyl-6-t-butylphenol), 1,3,5-tris(4-t-butyl-3-hydroxy-2,6-dimethylbenzyl) isocyanurate, tetrakis[methylene-3-(3',5'-di-t-butyl-4'-hydroxyphenyl) propionato]methane, and 3,9-bis[2-{3-(3-t-butyl-4-hydroxy-5-methylphenyl)propionyloxy}-1,1-dimethylethyl]-2,4,8,10-tetraoxaspiro[5.5]undecane.

Examples of the hindered amine compounds include bis(2,2,6,6-tetramethyl-4-piperidyl) sebacate, bis(1,2,2,6,6-pentamethyl-4-piperidyl) sebacate, 1-[2-{3-(3,5-di-t-butyl-4-hydroxyphenyl)propionyloxy}ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4.5]undecane-2,4-dione, 4-benzoyloxy-2,2,6,6-tetramethylpiperidine, dimethyl succinate/1-(2-hydroxyethyl)-4-hydroxy-2,2,6,6-tetramethylpiperidine polycondensates, poly[{6-(1,1,3,3-tetramethylbutyl)imino-1,3,5-triazine-2,4-diimino}{(2,2,6,6-tetramethyl-4-piperidyl)imino}hexamethylene{(2,3,6,6-tetramethyl-4-piperidyl)imino}], bis(1,2,2,6,6-pentamethyl-4-piperidyl) 2-(3,5-di-t-butyl-4-hydroxybenzyl)-2-n-butylmalonate, and N,N'-bis(3-aminopropyl) ethylenediamine/2,4-bis[N-butyl-N-(1,2,2,6,6-pentamethyl-4-piperidyl)amino]-6-chloro-1,3,5-triazine condensates.

Examples of the organosulfur antioxidants include dilauryl 3,3'-thiodipropionate, dimyristyl 3,3'-thiodipropionate, distearyl 3,3'-thiodipropionate, pentaerythritol tetrakis (β-laurylthiopropionate), ditridecyl 3,3'-thiodipropionate, and 2-mercaptobenzimidazole.

Examples of the organophosphorus antioxidants include trisnonylphenyl phosphite, triphenyl phosphite, and tris(2,4-di-t-butylphenyl) phosphite.

Of the antioxidants shown above, the organosulfur and organophosphorus antioxidants are called secondary antioxidants and can produce a synergistic effect when used in combination with primary antioxidants such as phenolic or amine compound antioxidants.

Examples of the light stabilizer include derivatives of benzophenone, benzotriazole, dithiocarbamate, tetramethylpiperidine, and the like.

More specifically, examples of the benzophenone light stabilizers include 2-hydroxy-4-methoxybenzophenone, 2-hydroxy-4-octoxybenzophenone, and 2,2'-dihydroxy-4-methoxybenzophenone.

Examples of the benzotriazole light stabilizers include 2-(2'-hydroxy-5$^1$-methylphenyl)benzotriazole, 2-[2'-hydroxy-3'-(3",4",5",6"-tetrahydrophthalimidomethyl)-5'-methylphenyl]benzotriazole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3',5'-t-butylphenyl)benzotriazole, 2-(2'-hydroxy-5'-t-octylphenyl)benzotriazole, and 2-(2'-hydroxy-3',5'-di-t-aminophenyl)benzotriazole. Also usable are 2,4-di-t-butylphenyl 3',5'-di-t-butyl-4'-hydroxybenzoate and nickel dibutyldithiocarbamate.

At least one electron-accepting substance may be incorporated into the photosensitive layer 16 (charge-generating layer 13, charge transport layer 14, etc.) for the purposes of improving sensitivity, reducing residual potential, reducing fatigue during repetitions of use, etc. Examples of the electron-accepting substance include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Especially preferred of these are the fluorenone and quinone compounds and the benzene derivatives having an electron-attracting substituent such as —Cl, —CN, or —$NO_2$.

As described above, in the first embodiment, the interlayer 13 which comprises fine metal oxide particles and a binder resin and satisfies the requirements concerning volume resistivity and its dependence on the environment has been formed between the electroconductive substrate 11 and the photosensitive layer 16. Due to this constitution, both of leakage preventive properties and electrical properties are sufficiently enhanced. Consequently, even when the electrophotographic photoreceptor is used together with a contact charging unit, it can attain satisfactory image quality without causing image quality defects such as fogging.

Second Embodiment

Figure 2:
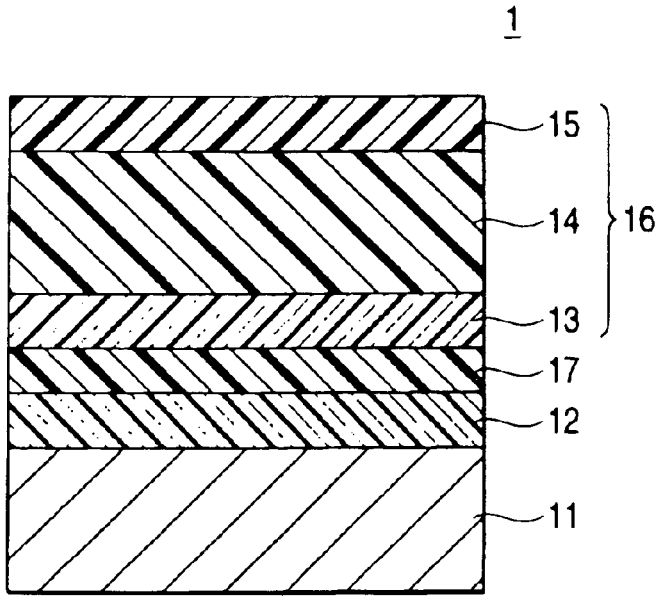
FIG. 2 is a diagrammatic sectional view illustrating an electrophotographic photoreceptor as the second embodiment of the invention.

FIG. 2 is a diagrammatic sectional view illustrating a second embodiment of the electrophotographic photoreceptor of the invention. The electrophotographic photoreceptor shown in FIG. 2 comprises an electroconductive substrate 11, an interlayer 12 formed thereon, and a photosensitive layer 16 formed on the interlayer 12. The photosensitive layer 16 is composed of an undercoat layer 17, a charge-generating layer 13, a charge transport layer 14, and a protective layer 15.

The undercoat layer 17 comprises a given resin and/or organometallic compound. Examples of the resin include acetal resins such as poly(vinylbutyral), poly(vinyl alcohol) resins, casein, polyamide resins, cellulosic resins, gelatins, polyurethane resins, polyester resins, methacrylic resins, acrylic resins, poly(vinyl chloride) resins, poly(vinyl acetate) resins, vinyl chloride/vinyl acetate/maleic anhydride resins, silicone resins, silicone-alkyd resins, phenol-formaldehyde resins, and melamine resins.

Examples of the organometallic compound include organometallic compounds containing one or more atoms of zirconium, titanium, aluminum, manganese, silicon, or the like. Specific examples thereof include organosilicon compounds such as vinyltrimethoxysilane, γ-methacryloxypropyltris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N,-bis(β-hydroxyethyl)-γ-aminopropyltriethoxysilane, and γ-chloropropyltrimethoxysilane; organozirconium compounds such as zirconium butoxide, zirconium ethyl acetoacetate, zirconium triethanolamine, acetylacetonatozirconium butoxide, (ethyl acetoacetate) zirconium butoxide, zirconium acetate, zirconium oxalate, zirconium lactate, zirconium phosphonate, zirconium octanoate, zirconium naphthenate, zirconium laurate, zirconium stearate, zirconium isostearate, zirconium methacrylate butoxide, zirconium stearate butoxide, and zirconium isostearate butoxide;

organotitanium compounds such as tetraisopropyl titanate, tetra-n-butyl titanate, butyl titanate dimer, tetra(2-ethylhexyl) titanate, titanium acetylacetonate, poly(titanium acetylacetonate), titanium octylene glycolate, titanium lactate ammonium salt, titanium lactate, titanium lactate ethyl ester, triethanolamine titanate, and polyhydroxytitanium stearate; and organoaluminum compounds such as aluminum isopropylate, monobutoxyaluminum diisopropylate, aluminum butylate, diethylacetoacetatoaluminum diisopropylate, and aluminum tris(ethylacetoacetate). Of these, the organozirconium and organosilicon compounds are superior in performance because they are effective in attaining a reduced residual potential, reduced environmental fluctuations in potential, a reduced potential change with repetitions of use, etc. Especially preferred are silane coupling agents such as vinyltriethoxysilane, vinyltris(2-methoxyethoxy)silane, 3-methacryloxypropyltrimethoxysilane, 3-glycidoxypropyltrimethoxysilane, 2-(3,4-epoxycyclohexyl)ethyltrimethoxysilane, N-2-(aminoethyl)-3-aminopropyltrimethoxysilane, N-2-(aminoethyl)-3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane.

The undercoat layer 17 can be formed from a coating fluid prepared by dispersing/dissolving the resin and/or the organometallic compound in a given solvent, in the same manner as for the interlayer 12. Although the solvents shown above in the explanation of the coating fluid for the interlayer 12 can be used for this coating fluid, it is preferred to select a solvent in which the interlayer 12 is poorly soluble. The thickness of the undercoat layer 17 is preferably from 0.1 to 3 μm. In case where the thickness of the undercoat layer exceeds 3 μm, an excessively high electrical barrier is formed and this tends to result in desensitization and a potential increase with repetitions of use.

As described above, the second embodiment has a constitution which differs from the constitution of the first embodiment only in that the undercoat layer 17 has been formed between the interlayer 12 and the photosensitive layer 16. Namely, the interlayer 12 in the second embodiment satisfies the requirements concerning volume resistivity and its dependence on the environment. Due to this constitution, both of leakage preventive properties and electrical properties are sufficiently enhanced. Consequently, even when this electrophotographic photoreceptor is used together with a contact charging unit, it can attain satisfactory image quality without causing image quality defects such as fogging. Like the first embodiment, the second embodiment produces the effect shown above. In addition, the undercoat layer 17 in the constitution described above interposed between the interlayer 12 and the photosensitive layer 16 can improve properties such as electrical properties, image quality, image quality retention, and adhesion between the photosensitive layer and the interlayer.

The electrophotographic photoreceptor of the invention should not be construed as being limited to the embodiments described above. For example, although the electrophotographic photoreceptors shown in FIGS. 1 and 2 have a protective layer 15, there is no need of forming the protective layer when the charge transport layer 14 or another layer has sufficiently high strength.

In the electrophotographic photoreceptors shown in FIGS. 1 and 2, the charge-generating layer 13 and the charge transport layer 14 have been superposed in this order from the substrate 11 side. However, this order may be reversed.

Furthermore, the electrophotographic photoreceptors shown in FIGS. 1 and 2 have the function-separated type photosensitive layer 16, which comprises the charge-generating layer 13 and charge transport layer 14 separately formed. However, the electrophotographic photoreceptor of the invention may be one having a single-layer type photosensitive layer containing both a charge-generating material and a charge-transporting material.

Third Embodiment

A third embodiment of the electrophotographic photoreceptor may be produced by a process in which an interlayer is formed in a step wherein metal oxide particles B are surface-treated with an organometallic compound having a hydrolyzable functional group and metal oxide particles A which satisfy the requirement represented by the following expression (2) are selected from the resultant surface-treated metal oxide particles A and used. In the steps of forming the constituent elements of the electrophotographic photoreceptor other than the interlayer, there are no particular limitations on the procedure or conditions, and known techniques can, for example, be used. Consequently, the step of forming an interlayer, which is an important part of preferred embodiments of processes for producing the electrophotographic photoreceptor of the invention, will be explained in the explanation of the interlayer in each of the embodiments of the electrophotographic photoreceptor of the invention.

$$1.0\times10^{-6}\leqq(I1/I2)\leqq1.0\times10^{-3} \quad (2)$$

(In expression (2),

I1 is the intensity of characteristic X-ray for the metal element serving as a component of the organometallic compound, the intensity of characteristic X-ray obtained through the analysis of the surface-treated metal oxide particles by fluorescent X-ray spectroscopy and I2 is the intensity of characteristic X-ray for the metal element serving as a component of the surface-treated metal oxide particles, the intensities of characteristic X-ray being obtained through analysis of the surface-treated metal oxide particles by fluorescent X-ray spectroscopy).

Figure 5:
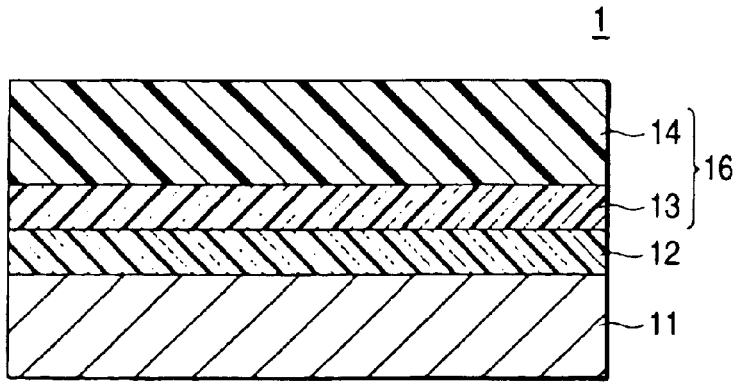
FIG. 5 is a diagrammatic sectional view illustrating an electrophotographic photoreceptor as the third embodiment of the invention.

FIG. 5 is a sectional view illustrating the third embodiment of the electrophotographic photoreceptor of the invention. The electrophotographic photoreceptor 1 shown in FIG. 5 is constituted of an electroconductive substrate 11, an interlayer 12, and a photosensitive layer 16. This electrophotographic photoreceptor 1 is produced by that photoreceptor production process for this embodiment which has been described above.

The electroconductive substrate 11 maybe one described in the first embodiment.

As stated above, the interlayer 12 comprises a binder resin and metal oxide particles A obtained by treating the surface of metal oxide particles B with a hydrolyzable organometallic compound. The interlayer 12 functions to inhibit charge injection from the electroconductive substrate 11 into the photosensitive layer 16 when the photosensitive layer 16 is in a charged state. The interlayer 12 functions also as an adhesive layer to enable the photosensitive layer 16 to be tenaciously bonded to and supported by the electroconductive substrate 11. Furthermore, this interlayer 12 functions to prevent light reflection on the electroconductive substrate 11.

The binder resin, which can be used in the interlayer 12 described in the first embodiment, may be used as the binder resin to be used in the interlayer 12 of the electrophotographic photoreceptor of this embodiment.

The metal oxide particles B preferably are particles of at least one member selected from the group consisting of tin oxide, titanium oxide, and zinc oxide.

The particle diameter of the metal oxide particles B preferably is 100 nm or smaller in terms of average particle diameter. The term "particle diameter" herein means average primary particle diameter. Although metal oxide particles having a powder resistivity of from $10^2$ to $10^{11}$ Ωcm can be used as the metal oxide particles B, it is especially preferred to employ metal oxide particles having a powder resistivity of from $10^4$ to $10^{10}$ Ωcm from the standpoint of imparting excellent leakage preventive properties to the interlayer 12. In case where the powder resistivity of the metal oxide particles B is lower than $10^2$ Ωcm, sufficient leakage preventive properties cannot be obtained. In case where the powder resistivity thereof exceeds $10^{11}$ Ωcm, an increase in residual potential tends to occur.

The specific surface area of the fine metal oxide particles B is preferably 10 $m^2/g$ or larger because it considerably influences electrophotographic properties. In case where the specific surface area thereof is smaller than 10 $m^2/g$, the interlayer 12 tends to have reduced electrification characteristics.

From the standpoint of diminishing fluctuations in the electrical resistivity of the interlayer 12 due to fluctuations in ambient temperature and humidity, the surface of the metal oxide particles B is treated with a hydrolyzable organometallic compound to obtain metal oxide particles A for use in the invention. By converting the metal oxide particles B to the metal oxide particles A through the surface treatment, the dispersed state of the metal oxide particles, which exerts a considerable influence on the electrical resistivity of the interlayer 12, can be easily controlled so as to be suitable for obtaining an electrical resistivity within the preferred range shown above.

This surface treatment comprises adsorbing a hydrolyzable organometallic compound onto the surface of the metal oxide particles B and then hydrolyzing the hydrolyzable group of the hydrolyzable organometallic compound. This surface treatment of the metal oxide particles B with a hydrolyzable organometallic compound may be conducted so as to cover the whole surface of the metal oxide particles B or to partly cover the surface thereof.

The hydrolyzable organometallic compound to be used in the invention is preferably one represented by the following general formula (3).

$$R_p\text{—M—}Y_q \quad (3)$$

In formula (3), R represents an organic group; M represents a metal element or silicon; Y represents a hydrolyzable functional group; and p and q each are an integer of 1 to 4, provided that the sum of p and q corresponds to the valence of M.

The organic group R is not particularly limited as long as it is a residue of an organic compound. Examples thereof include alkyl groups such as methyl, ethyl, propyl, butyl, and octyl, alkenyl groups such as vinyl and allyl, cycloalkyl groups such as cyclohexyl, aryl groups such as phenyl and naphthyl, alkaryl groups such as tolyl, arylalkyl groups such as benzyl and phenylethyl, arylalkenyl groups such as styryl, and heterocyclic groups such as furyl, thienyl, pyrrolidinyl, and imidazolyl. The organic group R in the hydrolyzable organometallic compound maybe one or more members selected from these organic compound residues.

Examples of the hydrolyzable functional group Y include ether groups such as methoxy, ethoxy, propoxy, butoxy, cyclohexyloxy, phenoxy, and benzyloxy, ester groups such as acetoxy, propionyloxy, acryloyloxy, methacryloyloxy, benzoyloxy, methanesulfonyloxy, benzenesulfonyloxy, and benzyloxycarbonyl, and halogen atoms such as chlorine.

M is not particularly limited as long as it is a metal other than the alkali metals or is silicon. Examples thereof include silicon and metals such as zirconium, titanium, aluminum, vanadium, chromium, manganese, iron, cobalt, nickel, copper, zinc, gallium, germanium, ruthenium, rhodium, palladium, indium, tin, and platinum.

The hydrolyzable organometallic compound having the organic group R and hydrolyzable functional group Y preferably is at least one member selected from the group consisting of silane coupling agents, titanate coupling agents, aluminate coupling agents, and organozirconium compounds each substituted with the organic group and hydrolyzable functional group. More preferably, the organometallic compound is one or more such silane coupling agents. These hydrolyzable organometallic compounds may be used alone or in combination of two or more thereof.

As to specific silane coupling agents, titanate coupling agents, and aliminate coupling agents, ones described in the first embodiment may be used.

Preferred of hydrolyzable organometallic compounds are silane coupling agents. It is more preferred to use a silane coupling agent having a mercapto group, in particular, γ-mercaptopropyltrimethoxysilane.

The amount of the hydrolyzable organometallic compound to be used for the surface treatment is optimized so as to obtain metal oxide particles A satisfying the requirement represented by expression (2) as stated above, according to conditions for the surface treatment, such as the combination of the hydrolyzable organometallic compound and the metal oxide particles B, temperature for the surface treatment reaction, apparatus to be used for the surface treatment, and scale of the metal oxide particles A to be prepared.

Methods for the surface treatment of the metal oxide particles B will be explained next. Methods for the surface treatment of the metal oxide particles B with a hydrolyzable organometallic compound are not particularly limited. The treatment may be conducted by a known method such as, e.g., a dry, wet, or vapor-phase process.

In the invention, use may be made of, for example, a method in which the metal oxide particles B are subjected to the surface treatment and metal oxide particles A which satisfy the requirement represented by expression (2) are separated from the resultant surface-treated metal oxide particles A. However, in the case where conditions for the surface treatment of the metal oxide particles B under which metal oxide particles A satisfying the requirement represented by expression (2) are obtained with satisfactory reproducibility can be easily optimized and grasped beforehand, all the metal oxide particles A obtained by the surface treatment of the metal oxide particles B under the optimized conditions can be used for forming the interlayer.

An example of the procedure of the surface treatment conducted by, e.g., a dry process is explained below. First, before being surface-treated, the metal oxide particles B are preliminarily dried at a temperature of from 100 to 150° C. to remove the water adherent to the particle surface. By thus removing the adherent water before the treatment, a hydrolyzable organometallic compound can be evenly adsorbed onto the surface of the metal oxide particles B. This predrying may be conducted while stirring the metal oxide particles B with a mixer having a high shearing force.

Subsequently, a hydrolyzable organometallic compound is adsorbed onto the surface of the metal oxide particles B. This step can be accomplished by spraying the hydrolyzable organometallic compound over the metal oxide particles B together with dry air or nitrogen gas while stirring the particles B with a mixer having a high shearing force, or by spraying a solution of the hydrolyzable organometallic compound in a solvent (e.g., an organic solvent or water) over the particles B together with dry air or nitrogen gas. Thus, the hydrolyzable organometallic compound is evenly adsorbed onto the surface of the metal oxide particles B.

The operation for adsorbing the hydrolyzable organometallic compound onto the surface of the metal oxide particles B is preferably conducted at a temperature of 50° C. or higher. In the case of using a solvent, it is preferred to conduct the operation at a temperature around the boiling point of the solvent.

Thereafter, baking is conducted at a temperature of 100° C. or higher, whereby the hydrolysis of the hydrolyzable organometallic compound can proceed sufficiently. This baking is preferably conducted at a temperature of from 150 to 250° C. When the baking temperature is lower than 150° C., there is the possibility that the hydrolysis of the hydrolyzable organometallic compound might be insufficient. When the baking temperature exceeds 250° C., there is the possibility that the hydrolyzable organometallic compound might decompose.

According to need, the metal oxide particles A obtained through the surface treatment are pulverized. Since this pulverization disaggregates agglomerates of the metal oxide particles A, it is effective in improving the dispersibility of the metal oxide particles in the interlayer 12.

An example of the procedure of the surface treatment conducted by a wet process is explained below. First, the fine metal oxide particles B are dispersed in a solvent with ultrasonic or a sand grinder-mill, attritor, ball mill, or the like. Subsequently, a liquid containing a hydrolyzable organometallic compound is added to the dispersion and this mixture is stirred to allow a surface treatment reaction to proceed. Thereafter, the solvent is removed from this liquid by distillation. The solid obtained after the solvent removal may be baked at 100° C. or higher. As in the dry process, the water adherent to the surface of the fine metal oxide particles B may be removed before the particles B are subjected to the surface treatment in this wet process. Besides the removal by thermal drying employed in the dry process, examples of methods usable for removing the adherent water include a method in which the particles B are stirred with heating in the solvent to be used for the surface treatment to thereby remove the water and a method in which the water is removed together with a solvent by azeotropy.

From the standpoints of preventing foreign substances such as external electroconductive particles from penetrating into the photoreceptor to form a cause of current leakage during contact charging and of forming an interlayer 12 having high durability, it is effective to heighten the hardness of the interlayer 12. The interlayer 12 is preferably regulated so as to have a Vickers hardness, as a hardness index, of 30 or higher, preferably 35 or higher.

From the standpoint of preventing the occurrence of Moire fringes, it is preferred that the interlayer 12 should have been regulated so as to have a surface roughness of from $(1/4n)\lambda$ to $\lambda$, wherein $\lambda$ is the wavelength of the laser light to be used for exposure and n is the refractive index of the overlying layer. The term "surface" used here means that surface of the interlayer 12 which faces the photosensitive layer 16. Resin particles may be incorporated into the interlayer 12 for the purpose of this surface roughness regulation. As the resin particles can be used silicone resin particles, particles of a crosslinked poly(methyl methacrylate) resin (PMMA), or the like.

Furthermore, the surface of the interlayer 12 may be polished for regulating the surface roughness. Examples of methods usable for the polishing include buff-polishing, sandblasting, wet honing, and grinding.

The formation of the interlayer 12 (step of forming the interlayer 12) is explained next. This interlayer 12 can be formed in the following manner. After the metal oxide particles B are surface-treated with at least one hydrolyzable organometallic compound, the particles satisfying the requirement represented by expression (2) selected from the resultant surface-treated metal oxide A are dispersed in any of the binder resins enumerated above to obtain a coating fluid. This coating fluid is applied to the electroconductive substrate 11 to form the interlayer 12.

As the solvent to be used for preparing the coating fluid for forming the interlayer 12, any desired solvent can be selected from known organic solvents such as, e.g., alcohol, aromatic, halogenated hydrocarbon, ketone, ketone alcohol, ether, and ester solvents.

For example, ordinary organic solvents can be used, such as methanol, ethanol, n-propanol, isopropanol, n-butanol, benzyl alcohol, methyl Cellosolve, ethyl Cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Those solvents for dispersion can be used alone or as a mixture of two or more thereof. When a solvent mixture is employed, any solvents can be used as long as the binder resin is soluble in the mixed solvent.

For dispersing the metal oxide particles A in the binder resin, the methods described in the first embodiment may be used. Further, as an applying method used to provide the interlayer, the methods described in the first embodiment may be used.

The photosensitive layer 16 is explained next. As shown in FIG. 5, the photosensitive layer 16 is composed of a charge-generating layer 13 and a charge transport layer 14.

The charge-generating layer 13 and the charge transport layer 14 used in the third embodiment may be the same as those described in the first embodiment.

For applying the coating fluid in forming the charge transport layer 14, an ordinary technique can be used, such as, e.g., blade coating, wire-wound bar coating, spray coating, dip coating, bead coating, air knife coating, or curtain coating.

Fourth Embodiment

Figure 6:
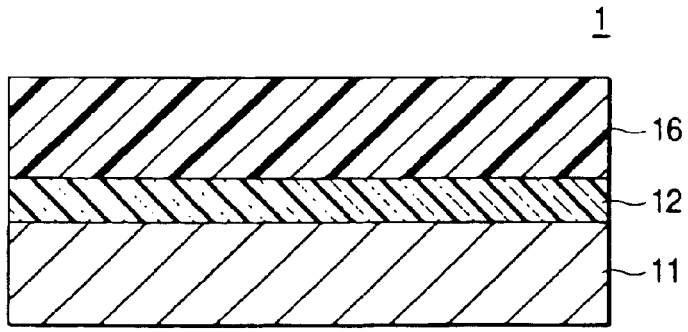
FIG. 6 is a diagrammatic sectional view illustrating an electrophotographic photoreceptor as the fourth embodiment of the invention.

FIG. 6 is a sectional view illustrating a fourth embodiment of the electrophotographic photoreceptor of the invention. The electrophotographic photoreceptor 1 shown in FIG. 6 has the same constitution as the electrophotographic photoreceptor 1 shown in FIG. 5, except that the photosensitive layer 16 has a single-layer structure.

The photosensitive layer 16 shown in FIG. 6 is a layer which comprises ingredients including both of the charge-generating material and charge-transporting material contained in the charge-generating layer 13 and charge transport layer 14 shown in FIG. 5.

When the photosensitive layer 16 is of the single-layer type as in this case, the content of the pigment is preferably from 0.1 to 50% by weight, more preferably from 1 to 20% by weight, based on the whole photosensitive layer 16. In case where the content of the pigment is lower than the lower limit of the range shown above, sufficient sensitivity is difficult to obtain. On the other hand, when the content of the pigment exceeds the upper limit of that range, troubles such as a decrease in electrification characteristics and a decrease in sensitivity are more apt to arise.

Especially preferred examples of the binder resin to be used for this photosensitive layer 16 of the single-layer type are polycarbonate resins and methacrylic resins from the standpoint of compatibility with hole-transporting materials. The binder resin to be used may be selected also from organic photoconductive polymers such as poly(N-vinylcarbazole), polyvinylanthracene, polyvinylpyrene, and polysilanes. These binder resins may be used alone or in combination of two or more thereof.

This photosensitive layer 16 also can be formed by mixing the charge-generating material with the charge-transporting material, organic solvent, and binder resin and with other ingredients to prepare a coating fluid, applying the coating fluid to the electroconductive substrate 11 by any of the coating techniques shown above, and then drying the coating.

Fifth Embodiment

Figure 7:
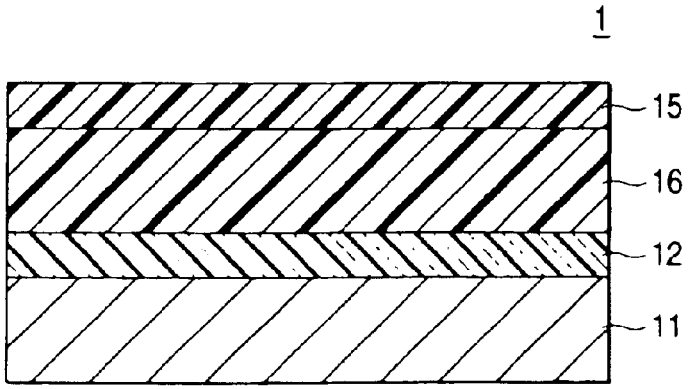
FIG. 7 is a diagrammatic sectional view illustrating an electrophotographic photoreceptor as the fifth embodiment of the invention.

FIG. 7 is a sectional view illustrating a fifth embodiment of the electrophotographic photoreceptor of the invention. The electrophotographic photoreceptor 1 shown in FIG. 7 has the same constitution as the electrophotographic photoreceptor 1 shown in FIG. 6, except that it has a protective layer 15 on the photosensitive layer 16 of a single-layer structure.

Sixth Embodiment

Figure 8:
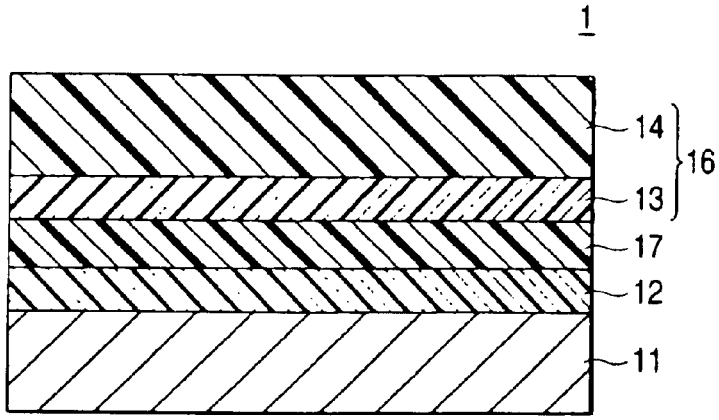
FIG. 8 is a diagrammatic sectional view illustrating an electrophotographic photoreceptor as the sixth embodiment of the invention.

FIG. 8 is a sectional view illustrating a sixth embodiment of the electrophotographic photoreceptor of the invention. The electrophotographic photoreceptor 1 shown in FIG. 8 has the same constitution as the electrophotographic photoreceptor 1 shown in FIG. 5, except that it has an undercoat layer 17 between the photosensitive layer 16 and the interlayer 12. This undercoat layer 17 has been formed for the purposes of improving the electrical properties of the photoreceptor 1, improving image quality, and improving the adhesion of the photosensitive layer 16.

Constituent materials for this undercoat layer 17 are not particularly limited, and can be selected at will from synthetic resins, powders of organic or inorganic materials, electron-transporting materials, etc.

Examples of the synthetic resins usable in the undercoat layer 17 include those enumerated above with regard to the embodiments described above. Also usable for the undercoat layer 17 besides these are zirconium chelate compounds, titanium chelate compounds, aluminum chelate compounds, titanium alkoxide compounds, organotitanium compounds, and silane coupling agents.

Those compounds may be used alone or as a mixture or polycondensate of two or more thereof. Of those, zirconium chelate compounds and silane coupling agents are superior in performance because they enable the photoreceptor to have a reduced residual potential and to undergo reduced fluctuations in potential with fluctuations in ambient conditions or with repetitions of use.

Fine particles of any of various organic compounds or inorganic compounds can be incorporated into the undercoat layer 17 for the purposes of improving electrical properties, improving light-scattering properties, etc. Especially effective are white pigments such as titanium oxide, zinc oxide, zinc flower, zinc sulfide, white lead, and lithopone, inorganic pigments for use as extenders, such as alumina, calcium carbonate, and barium sulfate, Teflon resin particles, benzoguanamine resin particles, styrene resin particles, and the like.

Such fine particles which can be added have a particle diameter of generally from 0.01 to 2 $\mu$m. Although the fine particles are added according to need, the amount thereof is preferably from 10 to 90% by weight, more preferably from 30 to 80% by weight, based on all solid components of the undercoat layer 17.

Incorporation of any of the electron-transporting materials and electron-generating pigments described above or the like into the undercoat layer 17 is also effective from the standpoint of attaining a reduced residual potential and environmental stability. The thickness of the undercoat layer 17 is preferably from 0.01 to 30 $\mu$m, more preferably from 0.05 to 25 $\mu$m.

In the case where a finely particulate material is added in preparing a coating fluid for forming the undercoat layer 17, the particulate material is added to a solution of a resinous ingredient and this mixture is subjected to a dispersion treatment. For this dispersion treatment can be used a roll mill, ball mill, vibration ball-mill, attritor, sand grinder-mill, colloid mill, paint shaker, or the like.

This undercoat layer 17 can be formed by applying a coating fluid for forming the undercoat layer 17 to the electroconductive substrate 11 and drying the coating. For applying the coating fluid, an ordinary technique can be used, such as, e.g., blade coating, wire-wound bar coating, spray coating, dip coating, bead coating, air knife coating, or curtain coating.

Seventh Embodiment

Figure 9:
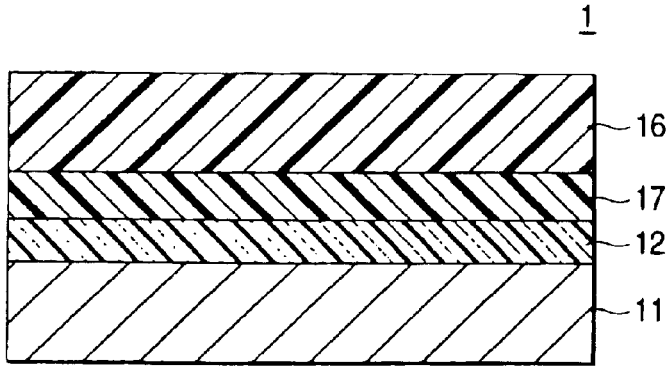
FIG. 9 is a diagrammatic sectional view illustrating an electrophotographic photoreceptor as the seventh embodiment of the invention.

FIG. 9 is a sectional view illustrating a seventh embodiment of the electrophotographic photoreceptor of the invention. The electrophotographic photoreceptor 1 shown in FIG. 9 has the same constitution as the electrophotographic photoreceptor 1 shown in FIG. 5, except that the photosensitive layer 16 has a single-layer structure and an undercoat layer 17 has been formed between the photosensitive layer 16 and the interlayer 12.

The undercoat layer 17 has the same constitution as in the photoreceptor 1 shown in FIG. 8 described above.

Eighth Embodiment

Figure 10:
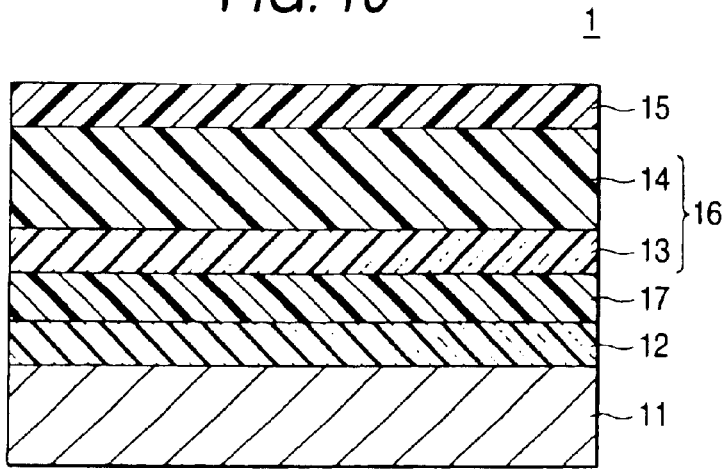
FIG. 10 is a diagrammatic sectional view illustrating an electrophotographic photoreceptor as the eighth embodiment of the invention.

FIG. 10 is a sectional view illustrating an eighth embodiment of the electrophotographic photoreceptor of the invention.

The electrophotographic photoreceptor 1 shown in FIG. 10 has the same constitution as the electrophotographic photoreceptor 1 shown in FIG. 5, except that it has a protective layer 15 on the photosensitive layer 16 and further has an undercoat layer 17 between the photosensitive layer 16 and the interlayer 12.

This undercoat layer 17 has the same constitutions as the undercoat layer 17 of the photoreceptor 1 shown in FIG. 8 described above. The protective layer 15 also has the same constitution as the protective layer 15 of the photoreceptor 1 shown in FIG. 1 described above.

Ninth Embodiment

Figure 11:
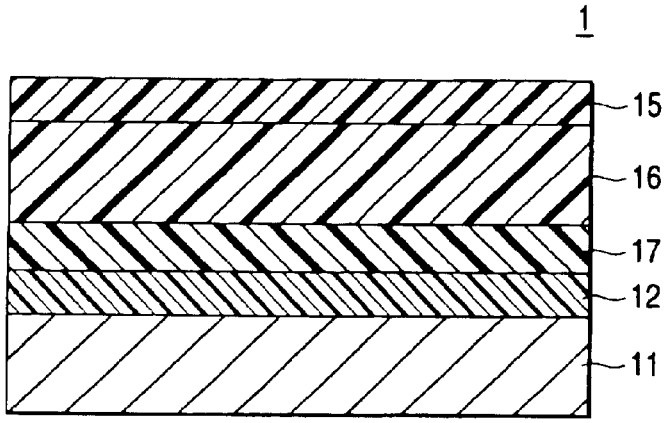
FIG. 11 is a diagrammatic sectional view illustrating an electrophotographic photoreceptor as the ninth embodiment of the invention.

FIG. 11 is a sectional view illustrating a ninth embodiment of the electrophotographic photoreceptor of the invention.

The electrophotographic photoreceptor 1 shown in FIG. 11 has the same constitution as the electrophotographic photoreceptor 1 shown in FIG. 5, except that a protective layer 15 has been formed on the photosensitive layer 16, the photosensitive layer 16 has a single-layer structure, and an undercoat layer 17 has been formed between the photosensitive layer 16 and the interlayer 12.

This undercoat layer 17 has the same constitution as the undercoat layer 17 of the photoreceptor 1 shown in FIG. 8 described above. The protective layer 15 also has the same constitution as the protective layer 15 of the photoreceptor 1 shown in FIG. 1 described above. Furthermore, the photosensitive layer 16 also has the same constitution as the photosensitive layer 16 of the photoreceptor 1 shown in FIG. 6 described above.

Although preferred embodiments of the electrophotographic photoreceptor of the invention have been explained in detail, the electrophotographic photoreceptor of the invention should not be construed as being limited to these embodiments.

A silicone oil as a leveling agent for improving the surface smoothness of coating films may be added in a slight amount to coating fluids for forming the photosensitive layers according to the invention.

The electrophotographic photoreceptor of the invention described above can be mounted in an electrophotographic apparatus such as a laser beam printer employing a near infrared or visible laser light, digital copier, LED printer, or laser facsimile telegraph, or in a process cartridge to be mounted on such an electrophotographic apparatus. The electrophotographic photoreceptor of the invention can be used in combination with a normal or reversal developer of the one-component or two-component type. Furthermore, even when mounted in an electrophotographic apparatus of the contact electrification type employing a charging roller or charging brush, the electrophotographic photoreceptor of the invention shows satisfactory properties with diminished current leakage.

Tenth Embodiment

The electrophotographic apparatus of the invention will be explained below.

Figure 3:
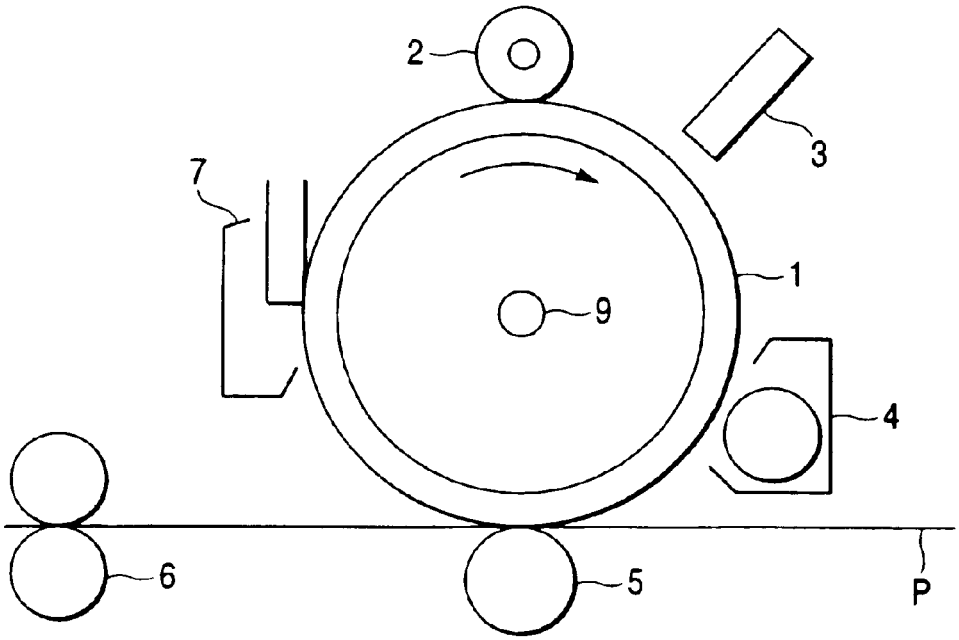
FIG. 3 is a diagrammatic sectional view illustrating an electrophotographic apparatus as the tenth embodiment of the invention.

FIG. 3 is a diagrammatic view illustrating the constitution of a tenth embodiment of the electrophotographic apparatus of the invention. The apparatus shown in FIG. 3 has an electrophotographic photoreceptor 1 having the constitution shown in FIG. 1. This electrophotographic photoreceptor 1 is supported by a support 9 and is revolvable on the support 9 at a given rotational speed in the direction indicated by the arrow. The apparatus comprises a contact charging unit 2, an exposure unit 3, a development unit 4, a transfer unit 5, and a cleaning unit 7 disposed in this order along the direction of revolution of the electrophotographic photoreceptor 1. The apparatus further has an image-fixing unit 6. A receiving medium P is sent via the transfer unit 5 to the image-fixing unit 6.

The contact charging unit 2 comprises a roller type contact charging member. When this contact charging member is disposed so as to be in contact with the surface of the photoreceptor 1 and a voltage is applied thereto, then the surface of the photoreceptor 1 can be electrified to a given potential. Examples of the material of this contact charging member include metals such as aluminum, iron, and copper, electroconductive polymeric materials such as polyacetylene, polypyrrole, and polythiophene, and composite materials comprising an elastomer material such as a polyurethane rubber, silicone rubber, epichlorohydrin rubber, ethylene/propylene rubber, acrylic rubber, fluororubber, styrene/butadiene rubber, or butadiene rubber and, dispersed therein, fine particles of carbon black, copper iodide, silver iodide, zinc sulfide, silicon carbide, a metal oxide, or the like. Examples of the metal oxide include ZnO, $SnO_2$, $TiO_2$, $In_2O_3$, $MoO_3$, and composite oxides of two or more of these. A perchlorate may be incorporated into the elastomer material to impart electrical conductivity.

A coating layer may be formed on the surface of the contact charging member. Examples of materials usable for forming the coating layer include N-alkoxymethylated nylons, cellulosic resins, vinylpyridine resins, phenolic resins, polyurethanes, poly(vinyl butyral), and melamine resins. These maybe used alone or in combination of two or more thereof. It is also possible to use a resin emulsion material such as, e.g., an acrylic resin emulsion, polyester resin emulsion, or polyurethane emulsion, in particular, a resin emulsion synthesized by soap-free emulsion polymerization. Particles of an electroconductive material may be dispersed in these resins for further regulating resistivity. An antioxidant may be incorporated therein for preventing deterioration. It is also possible to incorporate a leveling agent or surfactant into the resin emulsions in order to improve the film-forming properties required in coating layer formation.

The resistivity of the contact charging member is preferably from $10^0$ to $10^{14}$ Ωcm, more preferably from $10^2$ to $10^{12}$ Ωcm. The voltage to be applied to this contact charging member can be either a direct-current or an alternate-current voltage. A direct-current voltage superimposed on an alternate-current voltage can also be used.

In the apparatus shown in FIG. 3, the contact charging member of the contact charging unit 2 is in a roller form. However, this contact charge member may be in the form of a blade, belt, brush, etc.

As the exposure unit 3 can be employed an optical system capable of causing the light from a semiconductor laser, LED (light emitting diode), liquid-crystal shutter, or the like to desirably image-wise strike on the surface of the electrophotographic photoreceptor 1. In particular, when an exposure unit capable of exposing the photoreceptor surface to an incoherent light is used, interference fringes can be prevented from occurring between the support (substrate) and the photosensitive layer in the electrophotographic photoreceptor 1.

The development unit 4 can be a known development unit employing a normal or reversal developer of the single component or double component type or another type. The toner to be used is not particularly limited in particle shape. For example, an irregular-shape toner produced by the pulverization method or a spherical toner produced by the polymerization method is advantageously used.

Examples of the transfer unit 5 include a contact type transfer charging device employing a belt, roller, film, rubber blade, or the like and a scorotron transfer charging device and a corotron transfer charging device each utilizing a corona discharge.

The cleaning unit 7 serves to remove the residual toner adherent to the surface of the electrophotographic photoreceptor 1 after each transfer step. The electrophotographic photoreceptor 1 is thus cleaned and is then repeatedly subjected to the image-forming process. As the cleaning unit 7 can be used a cleaning blade, brush cleaning device, roll cleaning device, or the like. Preferred of these is a cleaning blade. Examples of the material of the cleaning blade include urethane rubbers, neoprene rubbers, and silicone rubbers.

As described above, in the tenth embodiment, the steps of charging, exposure, development, transfer, and cleaning take place successively in each rotation of the electrophotographic photoreceptor 1, whereby image formation is conducted repeatedly. This electrophotographic photoreceptor 1 has the specific interlayer formed between the electroconductive substrate and the photosensitive layer and combines leakage preventive properties and electrical properties on a sufficiently high level. Because of this, although the electrophotographic photoreceptor 1 is used together with the contact charging unit 2, satisfactory image quality can be obtained without causing image defects such as fogging. Consequently, this embodiment realizes an electrophotographic apparatus capable of stably providing images of satisfactory quality over long.

Eleventh Embodiment

Figure 12:
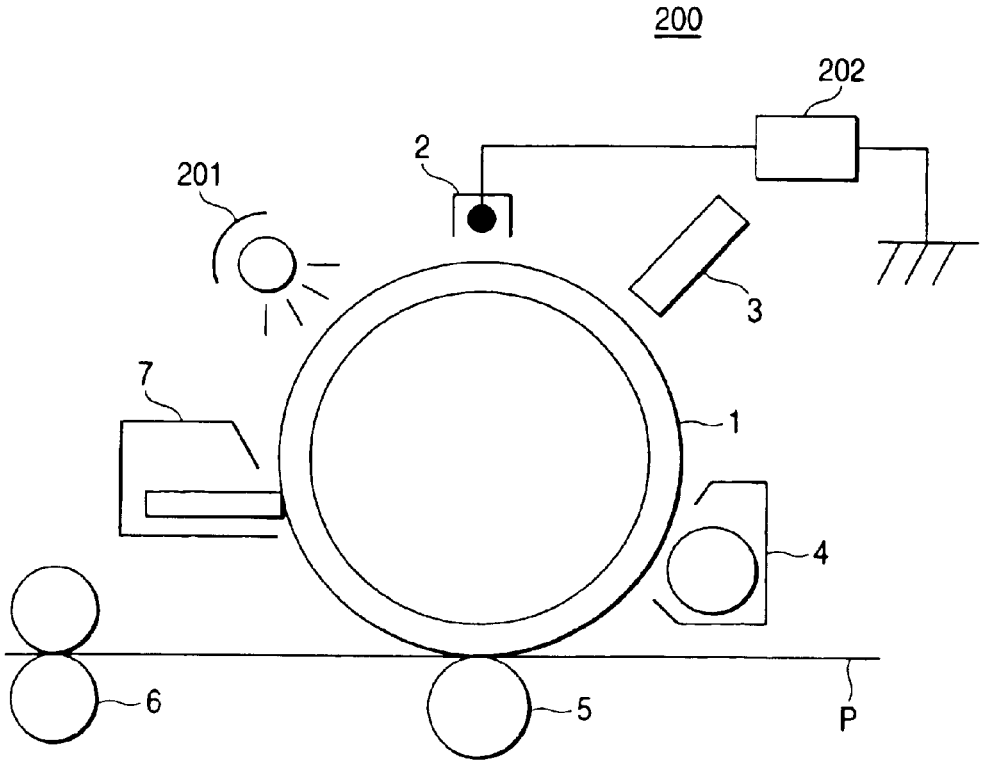
FIG. 12 is a diagrammatic sectional view illustrating an electrophotographic apparatus according to the eleventh embodiment of the invention.

FIG. 12 is a sectional view diagrammatically illustrating the basic constitution of a preferred embodiment of the electrophotographic apparatus of the invention. The electrophotographic apparatus 200 shown in FIG. 12 comprises: an electrophotographic photoreceptor 1; a charging unit 2, e.g., a corotron or scorotron, which charges the electrophotographic photoreceptor 1 by means of a corona discharge; a power supply 202 connected to the charging unit 2; an exposure unit 3 with which the electrophotographic photoreceptor 1 charged by the charging unit 2 is exposed to light to form an electrostatic latent image; a development unit 4 which develops with a toner the electrostatic latent image formed by the exposure unit 3 to thereby form a toner image; a transfer unit 5 which transfers the toner image formed by the development unit 4 to a receiving medium; a cleaning unit 13; an erase unit 201; and a fixing unit 6.

Figure 13:
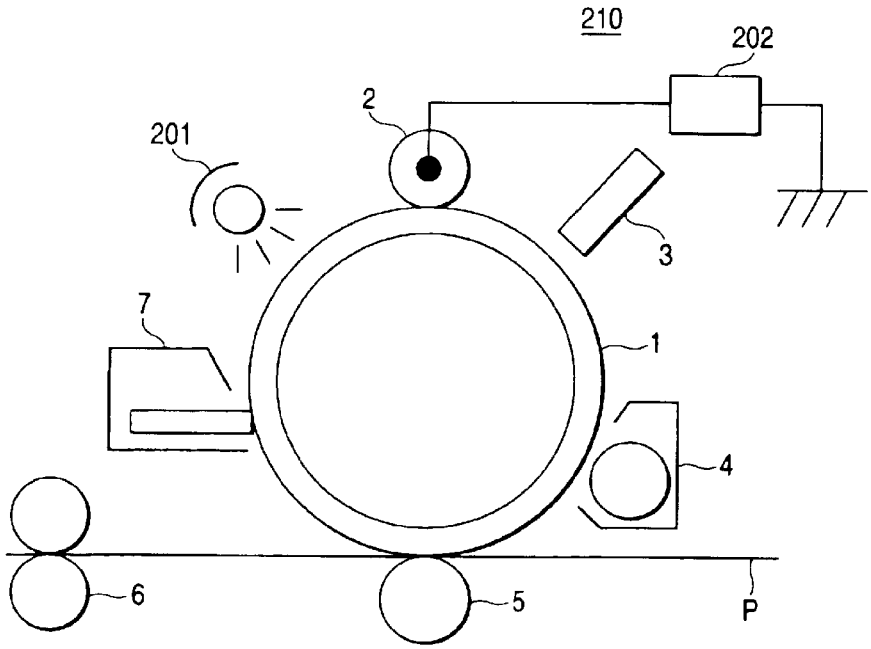
FIG. 13 is a diagrammatic sectional view illustrating another electrophotographic apparatus according to the eleventh embodiment of the invention.

FIG. 13 is a sectional view diagrammatically illustrating the basic constitution of another embodiment of the electrophotographic apparatus of the invention shown in FIG. 12.

The electrophotographic apparatus 210 shown in FIG. 13 has the same constitution as the electrophotographic apparatus 200 shown in FIG. 12, except that it has a charging unit 2 which charges the electrophotographic photoreceptor 1 by means of contact charging. In particular, a contact type charging unit employing a direct-current voltage superimposed on an alternate-current voltage can be advantageously used in electrophotographic apparatus because it has excellent wear resistance. Some of such electrophotographic apparatus do not have the erase unit 201.

The charging unit (charging member) 2 is disposed so as to be in contact with the surface of the photoreceptor 1. It applies a voltage evenly to the photoreceptor to charge the photoreceptor surface to a given potential.

Twelfth Embodiment

Figure 4:
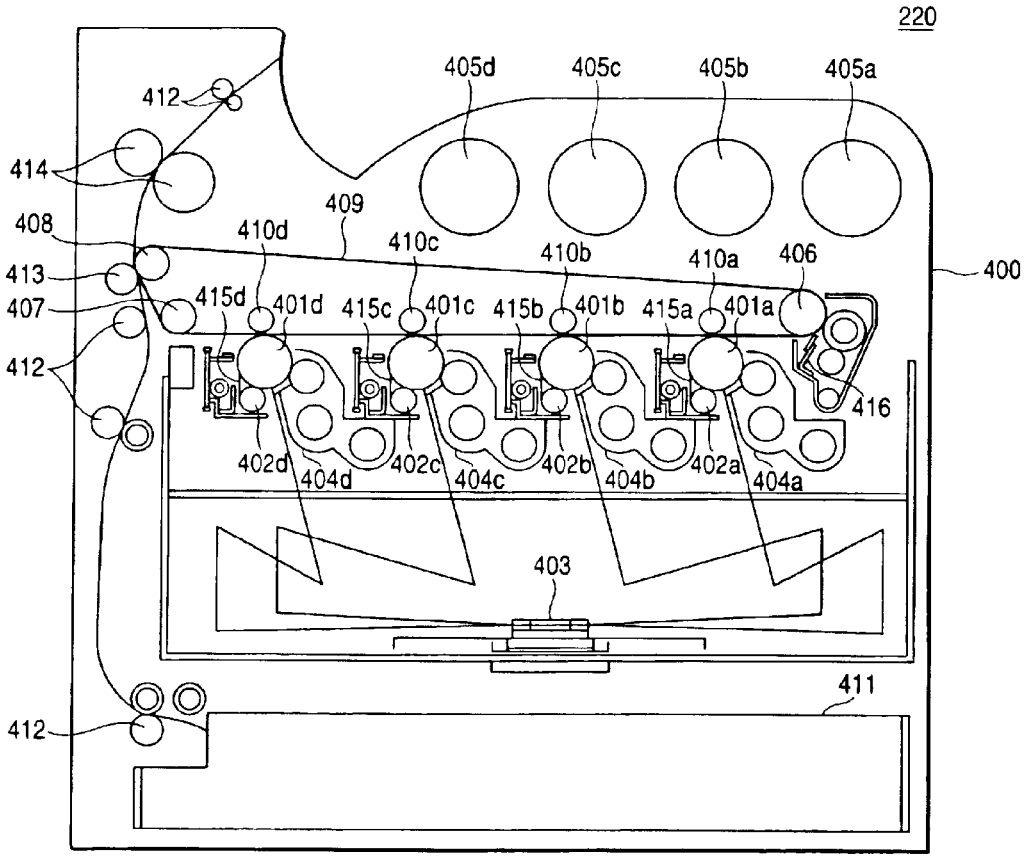
FIG. 4 is a diagrammatic sectional view illustrating an electrophotographic apparatus as the twelfth embodiment of the invention.

FIG. 4 is a sectional view illustrating an electrophotographic apparatus as a twelfth embodiment of the invention. The electrophotographic apparatus 220 shown in FIG. 4 is an intermediate transfer type electrophotographic apparatus, which has four electrophotographic photoreceptors 401*a* to 401*d* disposed in parallel with one another along an intermediate transfer belt 409 in a housing 400.

The electrophotographic photoreceptors 401*a* to 401*d* mounted in the electrophotographic apparatus 220 each are an electrophotographic photoreceptor according to the invention. For example, these photoreceptors each are the electrophotographic photoreceptor shown in FIG. 1. It is a matter of course that the photoreceptors 401*a* to 401*d* may be electrophotographic photoreceptors according to any of the other embodiments.

The electrophotographic photoreceptors 401*a* to 401*d* each are revolvable in a given direction (counterclockwise in the drawing). These photoreceptors 401*a* to 401*d* are equipped along the direction of revolution with charging rolls 402*a* to 402*d*, development units 404*a* to 404*d*, primary transfer rolls 410*a* to 410*d*, and cleaning blades 415*a* to 415*d*, respectively. Toners of four colors, i.e., yellow (Y), magenta (M), cyan (C), and black (K), stored in toner cartridges 405*a* to 405*d* can be supplied to the development units 404*a* to 404*d*, respectively. The primary transfer rolls 410*a* to 410*d* are respectively in contact with the electrophotographic photoreceptors 401*a* to 401*d* through the intermediate transfer belt 409.

A laser (exposure unit) 403 is disposed in a given position in the housing 400 so that the laser light emitted from the laser 403 can be caused to irradiate on the charged surface of the electrophotographic photoreceptors 401*a* to 401*d*. Thus, the steps of charging, exposure, development, primary transfer, and cleaning take place successively in a revolution of each of the electrophotographic photoreceptors 401*a* to 401*d*, whereby toner images of the respective colors are transferred to the intermediate transfer belt 409 so as to be superposed.

The intermediate transfer belt 409 are supported by a driving roll 406, a backup roll 408, and a tension roll 407 so as to have a given tension. By the revolution of these rolls, the transfer belt 409 can be caused to run without weighing down. A secondary transfer roll 413 is disposed so as to be in contact with the backup roll 408 through the intermediate transfer belt 409. That part of the intermediate transfer belt 409 which has passed through the gap between the backup roll 408 and the secondary transfer roll 413 is cleaned by a cleaning blade 416 and then repeatedly subjected to the subsequent cycle of the image-forming process.

The apparatus 220 further has a tray (receiving medium tray) 411 disposed in a given position within the housing 400. A receiving medium, e.g., paper, stored in the tray 411 is passed with conveying rolls 412 through the intermediate transfer belt 409 and the secondary transfer roll 413 and subsequently through two fixing rolls 414 in contact with each other, and is then discharged from the housing 400.

Figure 14:
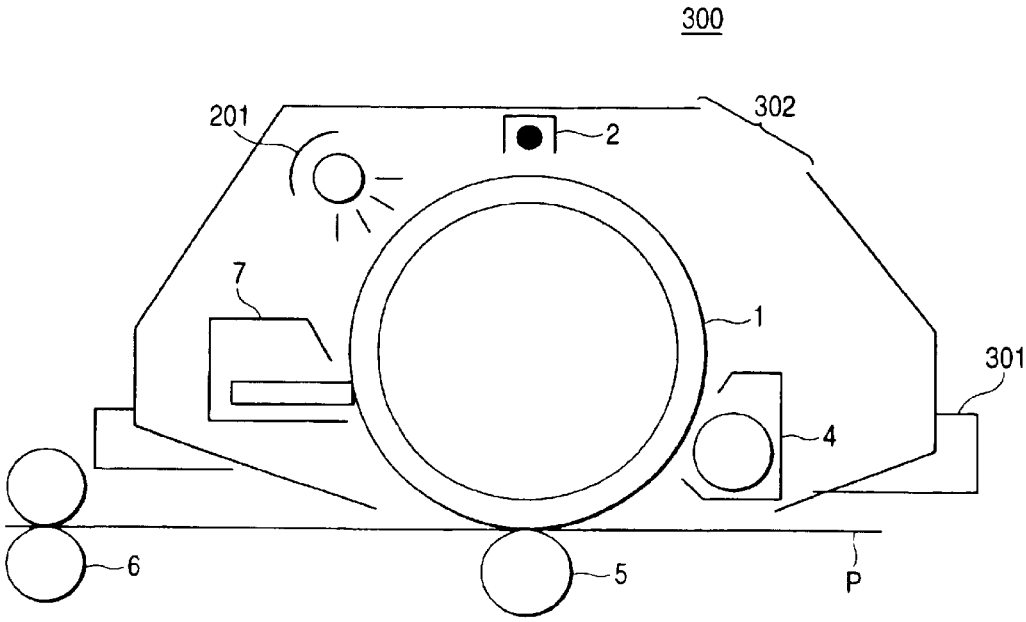
FIG. 14 is a sectional view diagrammatically illustrating the basic structure of a preferred embodiment of the process cartridge of the invention.

FIG. 14 is a sectional view diagrammatically illustrating the basic constitution of a preferred embodiment of the process cartridge of the invention. This process cartridge 300 comprises an electrophotographic photoreceptor 1 united with a charging unit 2, a development unit 4, a cleaning unit 7, and an erase unit 201 by means of an attachment rail 301, and has an aperture 302 for exposure.

This process cartridge 300 is capable of being freely attached to and removed from an electrophotographic apparatus main body comprising a transfer unit 5, a fixing unit 6, and other constituent parts not shown in the figure. Namely, this process cartridge in cooperation with the electrophotographic apparatus main body constitutes an electrophotographic apparatus.

The intermediate transfer belt 409 can be produced by the following procedure. A tetracarboxylic dianhydride or a derivative thereof is polymerized with a diamine in a substantially equimolar proportion in a given solvent to obtain a poly(amic acid) solution. This poly(amic acid) solution is fed to a cylindrical mold and spread into a film (layer). Thereafter, the polymer is imidized to thereby obtain the intermediate transfer belt 409 made of a polyimide resin.

Examples of the tetracarboxylic dianhydride include compounds represented by the following general formula (1):

(1)

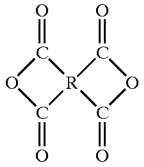

(wherein R represents a tetravalent organic group selected from the group consisting of aliphatic chain hydrocarbon groups, alicyclic hydrocarbon groups, aromatic hydrocarbon groups, and these hydrocarbon groups having one or more substituents). Specific examples thereof include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl) ether dianhydride, and ethylenetetracarboxylic dianhydride.

Examples of the diamine include 4,4'-diaminodiphenyl ether, 4,4'-diaminodiphenylmethane, 3,3'-diaminodiphenylmethane, 3,3'-dichlorobenzidine, 4,4'-diaminodiphenyl sulfide, 3,3'-diaminodiphenyl sulfone, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenyl sulfone, 4,4'-diaminodiphenylpropane, 2,4-bis(β-amino-t-butyl)toluene, bis(p-β-amino-t-butylphenyl) ether, bis(p-β-methyl-δ-aminophenyl)benzene, bis-p-(1,1-dimethyl-5-aminopentyl) benzene, 1-isopropyl-2,4-m-phenylenediamine, m-xylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

The solvent to be used for polymerizing the tetracarboxylic dianhydride with the diamine preferably is a polar solvent from the standpoints of solubility, etc. Preferred polar solvents are N,N-dialkylamides. More preferred are low-molecular polar solvents such as N,N-dimethylformamide, N,N-dimethylacetamide, N,N-diethylformamide, N,N-diethylacetamide, N,N-dimethylmethoxyacetamide, dimethyl sulfoxide, hexamethylphosphortriamide, N-methyl-2-pyrrolidone, pyridine, tetramethylene sulfone, and dimethyltetramethylene sulfone. These may be used alone or in combination of two or more thereof.

For the purpose of regulating the sheet resistance of the intermediate transfer belt 409 to be used in the invention, carbon may be dispersed in the polyimide resin. Although the kind of the carbon is not particularly limited, it is preferred to use an oxidized carbon black having oxygen-containing functional groups (e.g., carboxyl, quinone, lactone, or hydroxyl groups) formed on the surface by an oxidation treatment. A polyimide resin containing such an oxidized carbon black dispersed therein is less apt to be oxidized by repetitions of voltage application because the excess current resulting from voltage application flows through the oxidized carbon black. Furthermore, since the oxidized carbon black has high dispersibility in polyimide resins due to the oxygen-containing functional groups formed on the surface thereof, it is effective in diminishing unevenness of resistance, attaining a reduced dependence on electric fields, and inhibiting the application of a transfer voltage from causing electrostatic focusing. Consequently, an intermediate transfer belt can be obtained which is prevented from suffering a decrease in resistance upon application of a transfer voltage, has improved evenness in electrical resistance and a reduced dependence on electric fields, changes little in resistivity with changing ambient conditions, and is capable of giving high-quality images while inhibiting the occurrence of image quality defects such as blind spots occurring in those areas of paper which are in contact with conveying members.

The oxidized carbon black can be obtained, for example, by the air oxidation method in which a carbon black is contacted and reacted with air in a high-temperature atmosphere, a method in which a carbon black is reacted with a nitrogen oxide, ozone, or the like at ordinary temperature, or a method in which a carbon black is oxidized with air at a high temperature and then oxidized with ozone at a low temperature. Commercial products of such oxidized carbon may be used. Examples thereof include: MA 100 (pH, 3.5; volatile content, 1.5%), MA 100R (pH, 3.5; volatile content, 1.5%), MA 100S (pH, 3.5; volatile content, 1.5%), #970 (pH, 3.5; volatile content, 3.0%), MA 11 (pH, 3.5; volatile content, 2.0%), #1000 (pH, 3.5; volatile content, 3.0%), #2200 (pH, 3.5; volatile content, 3.5%), MA230 (pH, 3.0; volatile content, 1.5%), MA 220 (pH, 3.0; volatile content, 1.0%), #2650 (pH, 3.0; volatile content, 8.0%), MA 7 (pH, 3.0; volatile content, 3.0%), MA8 (pH, 3.0; volatile content, 3.0%), OIL 7B (pH, 3.0; volatile content, 6.0%), MA 77 (pH, 2.5; volatile content, 3.0%), #2350 (pH, 2.5; volatile content, 7.5%), #2700 (pH, 2.5; volatile content, 10.0%), and #2400 (pH, 2.5; volatile content, 9.0%) all manufactured by Mitsubishi Chemical Corp.; Printex 150T (pH, 4.5; volatile content, 10.0%), Special Black 350 (pH, 3.5; volatile content, 2.2%), Special Black 100 (pH, 3.3; volatile content, 2.2%), Special Black 250 (pH, 3.1; volatile content, 2.0%), Special Black 5 (pH, 3.0; volatile content, 15.0%), Special Black 4 (pH, 3.0; volatile content, 14.0%), Special Black 4A (pH, 3.0; volatile content, 14.0%), Special Black 550 (pH, 2.8; volatile content, 2.5%), Special Black 6 (pH, 2.5; volatile content, 18.0%), Color Black FW 200 (pH, 2.5; volatile content, 20.0%), Color Black FW 2 (pH, 2.5; volatile content, 16.5%), and Color Black FW 2V (pH, 2.5; volatile content, 16.5%) all manufactured by Degussa AG; and MONARCH 1000 (pH, 2.5; volatile content, 9.5%), MONARCH 1300 (pH, 2.5; volatile content, 9.5%), MONARCH 1400 (pH, 2.5; volatile content, 9.0%), MOGUL-L (pH, 2.5; volatile content, 5.0%), and REGAL 400R (pH, 4.0; volatile content, 3.5%) all manufactured by Cabot Corp.

Those oxidized carbons differ from one another in electrical conductivity due to differences in properties such as, e.g., the degree of oxidation, DBP absorption, and specific surface area measured by the BET method based on nitrogen adsorption. Although those carbon blacks may be used alone or in combination of two or more thereof, it is preferred to use a combination of two or more carbon blacks substantially differing in electrical conductivity. When two or more carbon blacks differing in properties are added as in the case described above, use may be made, for example, of a technique in which the carbon black having higher electrical conductivity is added preferentially and the carbon black having lower electrical conductivity is then added to regulate surface resistivity.

The content of those oxidized carbon blacks is preferably from 10 to 50% by weight, more preferably from 12 to 30% by weight, based on the polyimide resin. When the content thereof is lower than 10% by weight, there are cases where evenness of electrical resistance decreases and the intermediate transfer belt suffers a larger decrease in surface resistivity during repetitions of use. On the other hand, contents thereof exceeding 50% by weight are undesirable in that a desired resistivity value is difficult to obtain and the molded composition is brittle.

Examples of methods for producing a poly(amic acid) solution containing two or more oxidized carbon blacks dispersed therein include: a method in which the oxidized carbon blacks are dispersed beforehand in a solvent and the acid dianhydride and diamine are dissolved in this dispersion and polymerized therein; and a method which comprises separately dispersing the oxidized carbon blacks in a solvent to prepare corresponding carbon black dispersions, dissolving the acid anhydride and diamine in each of these dispersions and polymerizing the monomers therein, and then mixing the resultant poly(amic acid) solutions together.

The intermediate transfer belt 409 can be obtained by feeding the poly(amic acid) solution thus obtained to the inner surface of a cylindrical mold, spreading the solution on the inner surface to form a film, and imidizing the poly(amic acid) by heating. This imidization can be accomplished by holding the film-form poly(amic acid) at a given temperature for 0.5 hours or longer. Thus, an intermediate transfer belt having satisfactory flatness can be obtained.

Examples of methods for feeding the poly(amic acid) solution to the inner surface of a cylindrical mold include a method comprising supplying the solution with a dispenser and a method comprising supplying the solution through a die. The cylindrical mold to be used here preferably is one whose inner surface has been mirror-polished.

Methods for forming a film from the poly(amic acid) solution fed to a mold include centrifugal molding with heating, a method in which the solution is molded with a bullet-form running element, and rotational molding. A film having an even thickness is formed by these techniques.

Examples of methods for imidizing the thus-formed film to produce an intermediate transfer belt include (i) a method in which the mold bearing the film is placed in a drying oven and heated to a reaction temperature for imidization and (ii) a method which comprises removing the solvent to such a degree that the film becomes capable of retaining its shape as a belt, subsequently stripping the film from the inner surface of the mold, putting the film on the outer surface of a metallic cylinder, and heating the cylinder covered with the film to imidize the film. In the invention, imidization may be conducted by either of methods (i) and (ii) as long as the dynamic hardness of the surface of the thus-obtained intermediate transfer belt satisfies the requirement shown above. However, method (ii) is preferred in that imidization by method (ii) enables an intermediate transfer belt satisfactory in flatness and external-surface precision to be efficiently obtained without fail. Method (ii) will be explained below in detail.

Heating conditions for the solvent removal in method (ii) are not particularly limited as long as the solvent can be removed. However, the heating temperature is preferably from 80 to 200° C. and the heating period is preferably from 0.5 to 5 hours. The molding which has thus become capable of retaining its shape as a belt is stripped from the inner circumferential surface of the mold. For facilitating this stripping, the inner circumferential surface of the mold may be subjected to a treatment for imparting release properties.

Subsequently, the molding which has been heated and cured to such a degree that it can retain its shape as a belt is transferred to the outer surface of a metallic cylinder. This cylinder bearing the molding is heated to thereby allow imidization of the poly(amic acid) to proceed. The metallic cylinder preferably is one having a higher coefficient of linear expansion than the polyimide resin. Furthermore, when a cylinder having an outer diameter smaller by a given value than the inner diameter of the polyimide molding is used, then heat setting can be conducted and an endless belt having an even thickness can be obtained. The outer surface of the metallic cylinder preferably has a surface roughness (Ra) of from 1.2 to 2.0 μm. In case where the surface roughness (Ra) of the outer surface of the metallic cylinder is lower than 1.2 μm, the intermediate transfer belt which is being obtained does not undergo the slippage due to shrinkage in the belt axis direction because the metallic cylinder itself is too smooth. Consequently, stretching occurs in this step, and fluctuations in film thickness and a reduced flatness precision tend to result. On the other hand, in case where the surface roughness (Ra) of the outer surface of the metallic cylinder exceeds 2.0 μm, the shape of the outer surface of the metallic cylinder is transferred to the inner surface of the intermediate transfer belt being produced and causes the outer surface of the belt to develop irregularities. These surface irregularities tend to arouse image failures. The term "surface roughness" as used herein means the Ra as determined in accordance with JIS B601.

Heating conditions for the imidization preferably include a heating temperature of from 220 to 280° C. and a heating period of from 0.5 to 2 hours, although they depend on the composition of the polyimide resin. When imidization is conducted under such heating conditions, the polyimide resin shrinks more. Consequently, by mildly shrinking the polyimide resin in the belt axis direction, fluctuations in film thickness and a decrease in flatness precision can be prevented.

The outer surface of the intermediate transfer belt thus obtained, which is made of a polyimide resin, preferably has a surface roughness (Ra) of 1.5 μm or lower. In case where the surface roughness (Ra) of the intermediate transfer belt exceeds 1.5 μm, image defects such as graininess are apt to occur. The present inventors presume that graininess occurs by the following mechanism. The voltage applied for transfer or a discharge caused by release forms an electric field, which is locally concentrated on projections on the belt surface to alter the surface of these projections. Electrically conducting paths are thus newly formed to reduce resistivity. Consequently, the image obtained has a reduced density, resulting in graininess.

The intermediate transfer belt 409 thus obtained is preferably a seamless belt. When the intermediate transfer belt 409 is a seamless belt, the thickness thereof is preferably from 20 to 500 μm, more preferably from 50 to 200 μm, from the standpoint of mechanical properties such as strength and flexibility although it can be suitably determined according to the intended use. The surface resistance of the intermediate transfer belt 409 is such that the common logarithm of the surface resistivity thereof (Ω/□) is preferably from 8 to 15 (logΩ/□), more preferably from 11 to 13 (logΩ/□). The term "surface resistivity" as used here means the value obtained from a current value measured at 10 seconds after initiation of the application of a voltage of 100 V in an atmosphere of 22° C. and 55% RH.

The intermediate transfer belt 409 are supported by the driving roll 406, backup roll 408, and tension roll 407 so as to have a given tension. By the revolution of these rolls, the transfer belt 409 can be caused to run without weighing down. The secondary transfer roll 413 is disposed so as to be in contact with the backup roll 408 through the intermediate transfer belt 409. That part of the intermediate transfer belt 409 which has passed through the gap between the backup roll 408 and the secondary transfer roll 413 is cleaned by the cleaning blade 416 and then repeatedly subjected to the subsequent cycle of the image-forming process.

The apparatus 220 further has a tray (receiving medium tray) 411 disposed in a given position within the housing 400. A receiving medium, e.g., paper, stored in the tray 411 is passed with conveying rolls 412 through the intermediate transfer belt 409 and the secondary transfer roll 413 and subsequently through two fixing rolls 414 in contact with each other, and is then discharged from the housing 400.

As described above, in the electrophotographic apparatus 220 for color image formation as the twelfth embodiment, the electrophotographic photoreceptors 401*a* to 401*d* each are an electrophotographic photoreceptor according to the invention. Due to this constitution, the electrophotographic photoreceptors 401*a* to 401*d* each combine leakage preventive properties and electrical properties on a sufficiently high level in the image-forming process thereon. Because of this, although these electrophotographic photoreceptors are used together with the contact charging units 402*a* to 402*d*, satisfactory image quality can be obtained without causing image defects such as fogging. Consequently, an electrophotographic apparatus can be realized which is capable of stably maintaining images of satisfactory quality over long even when it is an electrophotographic apparatus for color image formation employing an intermediate transfer belt like this embodiment.

The invention should not be construed as being limited to the embodiments described above. For example, the apparatus respectively shown in FIGS. 3 and 4 each may have a process cartridge comprising the electrophotographic photoreceptor 1 (or 401*a* to 401*d*) and the charging unit 2 (or 402*a* to 402*d*) Use of this process cartridge facilities maintenance.

In those embodiments, fully satisfactory image quality can be obtained even when a noncontact type charging unit such as, e.g., a corotron charging device is used in place of the contact charging unit 2 (or 402*a* to 402*d*). However, it is preferred to employ a contact charging unit from the standpoint of avoiding ozone generation.

Furthermore, in the apparatus shown in FIG. 3, a toner image formed on the surface of the electrophotographic photoreceptor 1 is directly transferred to the receiving medium P. However, the electrophotographic apparatus of the invention may further have an intermediate transfer member. In this modification, a toner image formed on the surface of the electrophotographic photoreceptor 1 can be transferred to the intermediate transfer member and then to the receiving medium P. As this intermediate transfer member can be used one which has a multilayer structure comprising an electroconductive support, an elastic layer formed thereon comprising a rubber, elastomer, resin, etc., and at least one coating layer formed thereon.

The electrophotographic apparatus of the invention may further have an erase unit such as, e.g., an illuminator for emitting an erase light. In this modification, any residual potential on the electrophotographic photoreceptor is prevented from remaining in the subsequent cycle when the electrophotographic photoreceptor is repeatedly used, whereby image quality can be further heightened.

It is a matter of course that the same effect is obtained when the electrophotographic photoreceptor according to the first embodiment is replaced with the electrophotographic photoreceptor according to another embodiment.

EXAMPLES

The invention will be explained below in more detail by reference to Examples and Comparative Examples, but the invention should not be construed as being limited to the following Examples in any way.

(Preparation of Fine Metal Oxide Particle 1)

A hundred parts by weight of zinc oxide (Nano Tek ZnO, manufactured by C. I. Kasei Company, Ltd.) is mixed with 10 parts by weight of a toluene solution containing 10% by weight N-β(aminoethyl)-γ-aminopropyltrimethoxysilane as a coupling agent and 200 parts by weight of toluene. This mixture is refluxed for 2 hours with stirring. Thereafter, the system is evacuated to 10 mmHg to distill off the toluene. The residue is heated at 135° C. for 2 hours. Thus, fine metal oxide particles 1 are obtained.

The fine metal oxide particles 1 obtained are examined for BET specific surface area. The surface coverage thereof is determined from the found value of BET specific surface area, the weight of the fine metal oxide particles, and the minimum area capable of being covered with the coupling agent. The results obtained are shown in Table 1.

(Preparation of Fine Metal Oxide Particles 2 to 10)

The same coating treatment and heat treatment as for the fine metal oxide particles 1 are conducted, except that the kinds of the metal oxide and coupling agent and the amount of the coupling agent-containing toluene solution are changed as shown in Table 1. Thus, fine metal oxide particles 2 to 10 are obtained. The coupling agent solutions used are toluene solutions each containing a coupling agent in a concentration of 10% by weight. The surface coverages of the fine metal oxide particles 2 to 10 obtained are shown in Table 1.

(Preparation of Fine Metal Oxide Particles 11)

The fine metal oxide particles 1 are heated at 200° C. for 1 hour to obtain fine metal oxide particles 11. The surface coverage of the fine metal oxide particles 11 obtained is shown in Table 1.

TABLE 1

| Fine metal oxide particles | Metal oxide | Coupling agent | Amount of coupling agent solution [g] | Surface coverage [%] |
|---|---|---|---|---|
| 1 | Zinc oxide (Nano Tek ZnO, manufactured by C. I. Kasei) | N-β-(aminoethyl)-γ-aminopropyltrimethoxysilane | 10 | 10 |
| 2 | Zinc oxide (Nano Tek ZnO, manufactured by C. I. Kasei) | N-β-(aminoethyl)-γ-aminopropyltrimethoxysilane | 15 | 15 |
| 3 | Zinc oxide (Nano Tek ZnO, manufactured by C. I. Kasei) | N-β-(aminoethyl)-γ-aminopropyltrimethoxysilane | 20 | 20 |
| 4 | Zinc oxide (Nano Tek ZnO, manufactured by C. I. Kasei) | γ-methacryloxypropyltrimethoxysilane | 10 | 11 |
| 5 | Zinc oxide (Nano Tek ZnO, manufactured by C. I. Kasei) | γ-methacryloxypropyltrimethoxysilane | 15 | 16.5 |
| 6 | Zinc oxide (MZ-300, manufactured by Tayca) | N-β-(aminoethyl)-γ-aminopropyltrimethoxysilane | 10 | 10 |
| 7 | Zinc oxide (MZ-300, manufactured by Tayca) | γ-methacryloxypropyltrimethoxysilane | 10 | 11 |
| 8 | Titanium oxide (TAF-500J, manufactured by Fuji Titanium) | N-β-(aminoethyl)-γ-aminopropyltrimethoxysilane | 10 | 14 |
| 9 | Tin oxide (S1, manufactured by Mitsubishi Materials) | γ-methacryloxypropyltrimethoxysilane | 10 | 17 |
| 10 | Zinc oxide (Nano Tek ZnO, manufactured by C. I. Kasei) | N-β-(aminoethyl)-γ-aminopropyltrimethoxysilane | 5 | 5 |
| 11 | Zinc oxide (Nano Tek ZnO, manufactured by C. I. Kasei) | N-β-(aminoethyl)-γ-aminopropyltrimethoxysilane | 10 | 5 |

Example 1

(Production of Electrophotographic Photoreceptor)

Thirty-three parts by weight of the fine metal oxide particles 1 are mixed with 6 parts by weight of a blocked isocyanate (Sumidule 3175, manufactured by Sumitomo Bayer Urethane Co., Ltd.) and 25 parts by weight of methyl ethyl ketone for 30 minutes. To the resultant mixture are added 5 parts by weight of a butyral resin (BM-1, manufactured by Sekisui Chemical Co., Ltd.), 3 parts by weight of silicone balls (Tospearl 120, manufactured by Toshiba Silicone Co., Ltd.), and 0.01 part by weight of a leveling agent (Silicone Oil SH 29PA, manufactured by Dow Corning Toray Silicone Co., Ltd.). This mixture is subjected to a 2-hour dispersion treatment with a sand grinder-mill to obtain a coating fluid for interlayer formation. The coating fluid is applied by dip coating to the outer circumferential surface of a cylindrical aluminum substrate having a diameter of 30 mm, length of 404 mm, and wall thickness of 1 mm. The coating is dried and cured at 150° C. for 30 minutes to form an interlayer having a thickness of 20 μm.

A mixture composed of 15 parts by weight of chlorogallium phthalocyanine, as a charge-generating material, which in examination by X-ray diffractometry with a CuKα ray, give a diffraction spectrum having diffraction peaks at least at Bragg angles (2θ±0.2°) of 7.4°, 16.6°, 25.5°, and 28.3°, 10 parts by weight of a vinyl chloride/vinyl acetate copolymer resin (VMCH, manufactured by Nippon Unicar Co., Ltd.) as a binder resin, and 300 parts by weight of n-butyl alcohol is subjected to a dispersion treatment with a sand grinder-mill for 4 hours to obtain a coating fluid for charge-generating-layer formation. This coating fluid is applied to the interlayer by dip coating, and the coating is dried to form a charge-generating layer having a thickness of 0.2 μm.

To 80 parts by weight of chlorobenzene are added 4 parts by weight of N,N'-diphenyl-N,N'-bis(3-methylphenyl)-[1,1']-biphenyl-4,4'-diamine and 6 parts by weight of a bisphenol Z polycarbonate resin (molecular weight, 40,000). The amine and resin are dissolved in the solvent to obtain a coating fluid for charge transport layer formation. This coating fluid is applied to the charge-generating layer, and the coating is dried at 130° C. for 40 minutes to form a charge transport layer having a thickness of 25 μm. Thus, the target electrophotographic photoreceptor is obtained.

(Measurement of Volume Resistivity of Interlayer)

The coating fluid for interlayer formation described above is applied to an aluminum substrate by dip coating, and the coating is dried at 150° C. for 30 minutes to form an interlayer (thickness, 20 μm). The volume resistivity of this interlayer is measured while applying an electric field of $10^7$ V/m or $10^6$ V/m thereto using a 1-mm diameter gold electrode as a counter electrode. This measurement is made under high-temperature high-humidity (28° C., 85% RH) conditions and low-temperature low-humidity (15° C., 15% RH) conditions. The results obtained are shown in Table 2. In Table 2, $\rho^1$ to $\rho^3$ mean the volume resistivities measured under the respective conditions shown below. Values of $\rho^2/\rho^1$ and $\rho^1/\rho^3$ are also shown in Table 2.

$\rho^1$: volume resistivity measured in an electrical field of $10^6$ V/m at 28° C. and 85% RH.

$\rho^2$: volume resistivity measured in an electric field of $10^6$ V/m at 15° C. and 15% RH.

$\rho^3$: volume resistivity measured in an electric field of $10^7$ V/m at 28° C. and 85% RH.

(Production of Electrophotographic Apparatus and Continuous Printing Test 1)

Using the photoreceptor obtained, an electrophotographic apparatus is produced. This electrophotographic apparatus has the same constitution as full-color printer Docu Print C2220 (having a contact charging unit and an intermediate transfer unit), manufactured by Fuji Xerox Co., Ltd.

This electrophotographic apparatus is subjected to a 50,000-sheet continuous printing test. An initial print and the 25,000th and 50,000th prints obtained in this test are evaluated for image quality. The results obtained are shown in Table 2.

Examples 2 to 10

Electrophotographic photoreceptors are produced in Examples 2 to 10 in the same manner as in Example 1, except that the fine metal oxide particles 2 to 5, 11, and 6 to 10 are respectively used in place of the fine metal oxide particles 1. The interlayers are examined for volume resistivity in the same manner as in Example 1. The results obtained are shown in Table 2.

Furthermore, electrophotographic apparatus are produced using the respective electrophotographic photoreceptors in the same manner as in Example 1 and subjected to a 50,000-sheet continuous printing test. The results of image quality evaluation obtained are shown in Table 2.

Comparative Example 1

An electrophotographic photoreceptor and an electrophotographic apparatus are produced in the same manner as in Example 1, except that zinc oxide (Nano Tek ZnO, manufactured by C. I. Kasei Company, Ltd.) is used without being subjected to any surface treatment in place of the fine metal oxide particles 1. The volume resistivity of the interlayer is measured and a 50,000-sheet continuous printing test is conducted, in the same manner as in Example 1. The results obtained are shown in Table 2.

Comparative Example 2

An electrophotographic photoreceptor and an electrophotographic apparatus are produced in the same manner as in Example 1, except that the fine metal oxide particles 10 are used in place of the fine metal oxide particles 1. The volume resistivity of the interlayer is measured and a 50,000-sheet continuous printing test is conducted, in the same manner as in Example 1. The results obtained are shown in Table 2.

Comparative Example 3

An electrophotographic photoreceptor and an electrophotographic apparatus are produced in the same manner as in Example 1, except that zinc oxide (MZ-300, manufactured by Tayca Corp.) is used without being subjected to any surface treatment in place of the fine metal oxide particles 1. The volume resistivity of the interlayer is measured and a 50,000-sheet continuous printing test is conducted, in the same manner as in Example 1. The results obtained are shown in Table 2.

Comparative Example 4

An electrophotographic photoreceptor and an electrophotographic apparatus are produced in the same manner as in Example 1, except that titanium oxide (TAF-500J, manufactured by Fuji Titanium Co., Ltd.) is used without being subjected to any surface treatment in place of the fine metal oxide particles 1. The volume resistivity of the interlayer is measured and a 50,000-sheet continuous printing test is conducted, in the same manner as in Example 1. The results obtained are shown in Table 2.

Comparative Example 5

An electrophotographic photoreceptor and an electrophotographic apparatus are produced in the same manner as in Example 1, except that tin oxide (S1, manufactured by Mitsubishi Materials Corp.) is used without being subjected to any surface treatment in place of the fine metal oxide particles 1. The volume resistivity of the interlayer is measured and a 50,000-sheet continuous printing test is conducted, in the same manner as in Example 1. The results obtained are shown in Table 2.

TABLE 2

| | Volume resistivity of interlayer | | | | | Continuous printing test | | |
|---|---|---|---|---|---|---|---|---|
| | $\rho^1$ [Ω.cm] | $\rho^2$ [Ω.cm] | $\rho^3$ [Ω.cm] | $\rho^2/\rho^1$ | $\rho^1/\rho^3$ | Initial | 25,000th print | 50,000th print |
| Example 1 | $1 \times 10^8$ | $3 \times 10^{10}$ | $5 \times 10^5$ | 300 | 200 | good | good | slight blurring |
| Example 2 | $5 \times 10^8$ | $5 \times 10^{10}$ | $5 \times 10^5$ | 100 | 1000 | good | good | good |
| Example 3 | $1 \times 10^9$ | $1 \times 10^{11}$ | $2 \times 10^6$ | 100 | 500 | good | good | slight decrease in density |
| Example 4 | $2 \times 10^8$ | $4 \times 10^{10}$ | $5 \times 10^5$ | 200 | 400 | good | good | slight blurring |
| Example 5 | $4 \times 10^8$ | $8 \times 10^{10}$ | $8 \times 10^5$ | 200 | 500 | good | good | good |
| Example 6 | $1 \times 10^8$ | $5 \times 10^9$ | $2 \times 10^6$ | 50 | 50 | good | good | good |
| Example 7 | $6 \times 10^{10}$ | $7 \times 10^{11}$ | $5 \times 10^9$ | 12 | 12 | good | good | slight decrease in density |
| Example 8 | $5 \times 10^{10}$ | $3 \times 10^{11}$ | $1 \times 10^{10}$ | 6 | 5 | good | good | slight decrease in density |
| Example 9 | $1 \times 10^{10}$ | $5 \times 10^{12}$ | $2 \times 10^7$ | 500 | 500 | good | good | slight decrease in density |
| Example 10 | $2 \times 10^8$ | $6 \times 10^{10}$ | $4 \times 10^5$ | 300 | 500 | good | good | slight blurring |
| Comparative Example 1 | $2 \times 10^6$ | $1 \times 10^{10}$ | $2 \times 10^4$ | 5000 | 100 | good | blurring, decrease in density | (printing is stopped) |

TABLE 2-continued

| | Volume resistivity of interlayer | | | | | Continuous printing test | | |
|---|---|---|---|---|---|---|---|---|
| | $\rho^1$ [Ω.cm] | $\rho^2$ [Ω.cm] | $\rho^3$ [Ω.cm] | $\rho^2/\rho^1$ | $\rho^1/\rho^3$ | Initial | 25,000th print | 50,000th print |
| Comparative Example 2 | $1 \times 10^7$ | $2 \times 10^{10}$ | $2 \times 10^5$ | 2000 | 50 | good | blurring, decrease in density | (printing is stopped) |
| Comparative Example 3 | $1 \times 10^9$ | $2 \times 10^{12}$ | $7 \times 10^7$ | 2000 | 14 | blurring | leakage | (printing is stopped) |
| Comparative Example 4 | $5 \times 10^7$ | $1 \times 10^{12}$ | $1 \times 10^5$ | 20000 | 500 | blurring | decrease in density, leakage | (printing is stopped) |
| Comparative Example 5 | $2 \times 10^7$ | $1 \times 10^{10}$ | $5 \times 10^4$ | 500 | 400 | blurring | leakage | (printing is stopped) |

Table 2 shows the following. In Examples 1 to 10, image quality defects such as fogging and a decrease in density can be sufficiently prevented and satisfactory image quality can be stably obtained over long. In contrast, in Comparative Examples 1 to 5, image quality defects such as fogging, leakage, and a decrease in image density come to be observed in relatively early stages. The photoreceptors in the Comparative Examples do not withstand 25,000-sheet continuous printing.

Example 11

A hundred parts by weight of tin oxide (S1, manufactured by Mitsubishi Materials Corp.; specific surface area, 50 $m^2/g$) is mixed with 500 parts by weight of toluene with stirring. Thereto is added 15 parts by weight of a silane coupling agent (A1100, manufactured by Nippon Unicar Co., Ltd.). This mixture is stirred for 5 hours. Thereafter, the toluene is removed by vacuum distillation. The residual solid is heated (baked) at 120° C. for 2 hours. Since agglomerates are observed in the solid after this heat treatment, the solid is pulverized with a pin mill. The resultant powder is further heated at 190° C. for 2 hours to obtain a coated tin oxide.

Thirty-five parts by weight of the coated tin oxide is mixed with 15 parts by weight of a blocked isocyanate (Sumidule 3175, manufactured by Sumitomo Bayer Urethane Co., Ltd.) as a hardener, 6 parts by weight of a butyral resin (BM-1, manufactured by Sekisui Chemical Co., Ltd.), and 44 parts by weight of methyl ethyl ketone. This mixture is subjected to a 2-hour dispersion treatment with a sand grinder-mill using 1-mm diameter glass beads to obtain a dispersion. To this dispersion are added 0.005 parts by weight of dioctyltin dilaurate as a catalyst and 0.01 part by weight of a silicone oil (SH 29PA, manufactured by Dow Corning Toray Silicone Co., Ltd.). Thus, a coating fluid for interlayer formation is obtained. This coating fluid is applied by dip coating to the outer circumferential surface of an aluminum substrate (diameter, 30 mm; axis-direction length, 340 mm; wall thickness, 1 mm). The coating is dried and cured at 160° C. for 100 minutes. Thus, an interlayer having a thickness of 20 μm is formed. The volume resistivities $\rho^1$ to $\rho^3$ of this interlayer and the values of $\rho^2/\rho^1$ and $\rho^1/\rho^3$ are shown in Table 3.

A mixture composed of 15 parts by weight of chlorogallium phthalocyanine, as a charge-generating material, which in examination by X-ray diffractometry with a CuKα ray, give a diffraction spectrum having diffraction peaks at least at Bragg angles (2θ±0.2°) of 7.4°, 16.6°, 25.5°, and 28.3°, 10 parts by weight of a vinyl chloride/vinyl acetate copolymer resin (VMCH, manufactured by Nippon Unicar Co., Ltd.) as a binder resin, and 300 parts by weight of n-butyl alcohol is subjected to a dispersion treatment with a sand grinder-mill using 1-mm diameter glass beads for 4 hours to obtain a coating fluid for charge-generating-layer formation. This coating fluid is applied to the interlayer by dip coating, and the coating is dried to form a charge-generating layer having a thickness of 0.2 μm.

To 80 parts by weight of chlorobenzene are added 4 parts by weight of N,N'-diphenyl-N,N'-bis(3-methylphenyl)-[1,1']-biphenyl-4,4'-diamine and 6 parts by weight of a bisphenol Z polycarbonate resin (molecular weight, 40,000). The amine and resin are dissolved in the solvent to obtain a coating fluid for charge transport layer formation. This coating fluid is applied to the charge-generating layer, and the coating is dried at 130° C. for 40 minutes to form a charge transport layer having a thickness of 25 μm. Thus, the target electrophotographic photoreceptor is obtained.

Comparative Example 6

An interlayer, charge-generating layer, and charge transport layer are formed to produce an electrophotographic photoreceptor in the same manner as in Example 11, except that the 2-hour heat treatment at 190° C. (second-stage heat treatment) in the coating of tin oxide is omitted.

Example 12

A liquid mixture of 2 parts by weight of a silane coupling agent (KBM 503, manufactured by Shin-Etsu Chemical Co., Ltd.) and 10 parts by weight of toluene is added to 100 parts by weight of titanium oxide (TAF 500J, manufactured by Fuji Titanium Co., Ltd.; specific surface area, 18 $m^2/g$) which is kept being stirred in a mixer. The resultant mixture is stirred for 10 minutes. Therefore, the mixture is heated at 130° C. for 2 hours. Since agglomerates are observed in the solid obtained, it is pulverized with a pin mill for 1 hour. The resultant powder is further heated at 180° C. for 1 hour to obtain a coated titanium oxide.

Fifty parts by weight of the coated titanium oxide is mixed with 15 parts by weight of a blocked isocyanate (Sumidule 3175, manufactured by Sumitomo Bayer Urethane Co., Ltd.) as a hardener, 6 parts by weight of a butyral resin (BM-1, manufactured by Sekisui Chemical Co., Ltd.), and 60 parts by weight of methyl ethyl ketone. This mixture is subjected to a 4-hour dispersion treatment with a sand grinder-mill using 1-mm diameter glass beads to obtain a dispersion. To this dispersion are added 0.005 parts by weight of dioctyltin dilaurate as a catalyst and 0.01 part by weight of a silicone oil (SH 29PA, manufactured by Dow Corning Toray Silicone Co., Ltd.).

An interlayer, charge-generating layer, and charge transport layer are formed in the same manner as in Example 11, except that the coating fluid for interlayer formation obtained above is used. Thus, the target electrophotographic photoreceptor is obtained. The volume resistivities $\rho^1$ to $\rho^3$ of this interlayer and the values of $\rho^2/\rho^1$ and $\rho^1/\rho^3$ are shown in Table 3.

Comparative Example 7

An interlayer, charge-generating layer, and charge transport layer are formed to produce an electrophotographic photoreceptor in the same manner as in Example 12, except that the 1-hour heat treatment at 180° C. (second-stage heat treatment) in the coating of titanium oxide is omitted.

Example 13

A hundred parts by weight of zinc oxide (manufactured by Tayca Corp.; specific surface area, 15 $m^2/g$; average particle diameter, 70 $\mu$m) is mixed with 500 parts by weight of toluene with stirring. Thereto is added 1.5 parts by weight of a silane coupling agent (KBM 603, manufactured by Shin-Etsu Chemical Co., Ltd.). This mixture is stirred for 2 hours. Thereafter, the toluene is removed by vacuum distillation. The residual solid is heated at 150° C. for 2 hours. Since agglomerates are observed in the solid after this heat treatment, the solid is pulverized with a pin mill for 2 hours. The resultant powder is further heated at 200° C. for 2 hours to obtain a coated zinc oxide.

Sixty parts by weight of the coated zinc oxide is mixed with 15 parts by weight of a blocked isocyanate (Sumidule 3175, manufactured by Sumitomo Bayer Urethane Co., Ltd.) as a hardener, 25 parts by weight of methyl ethyl ketone, and 38 parts by weight of a solution prepared by dissolving 15 parts by weight of a butyral resin (BM-1, manufactured by Sekisui Chemical Co., Ltd.) in 85 parts by weight of methyl ethyl ketone. This mixture is subjected to a 2-hour dispersion treatment with a sand grinder-mill using 1-mm diameter glass beads to obtain a dispersion. To this dispersion are added 0.005 parts by weight of dioctyltin dilaurate as a catalyst and 0.01 part by weight of a silicone oil (SH 29PA, manufactured by Dow Corning Toray Silicone Co., Ltd.). Thus, a coating fluid for interlayer formation is obtained.

An interlayer is formed in the same manner as in Example 11, except that the coating fluid for interlayer formation obtained above is used. The volume resistivities $\rho^1$ to $\rho^3$ of this interlayer and the values of $\rho^2/\rho^1$ and $\rho^1/\rho^3$ are shown in Table 3.

A mixture composed of 15 parts by weight of hydroxygallium phthalocyanine, as a charge-generating material, which in examination by X-ray diffractometry with a CuK$\alpha$ ray, give a diffraction spectrum having diffraction peaks at least at Bragg angles (2$\theta$±0.2°) of 7.3°, 16.0°, 24.9°, and 28.0°, 10 parts by weight of a vinyl chloride/vinyl acetate copolymer resin (VMCH, manufactured by Nippon Unicar Co., Ltd.) as a binder resin, and 300 parts by weight of n-butyl alcohol is subjected to a dispersion treatment with a sand grinder-mill using 1-mm diameter glass beads for 4 hours to obtain a coating fluid for charge-generating-layer formation. This coating fluid is applied to the interlayer by dip coating, and the coating is dried to form a charge-generating layer having a thickness of 0.2 $\mu$m.

To 80 parts by weight of chlorobenzene are added 4 parts by weight of N,N'-diphenyl-N,N'-bis(3-methylphenyl)-[1,1']-biphenyl-4,4'-diamine and 6 parts by weight of a bisphenol Z polycarbonate resin (molecular weight, 40,000). The amine and resin are dissolved in the solvent to obtain a coating fluid for charge transport layer formation. This coating fluid is applied to the charge-generating layer, and the coating is dried at 130° C. for 40 minutes to form a charge transport layer having a thickness of 25 $\mu$m. Thus, the target electrophotographic photoreceptor is obtained.

Comparative Example 8

An interlayer, charge-generating layer, and charge transport layer are formed to produce an electrophotographic photoreceptor in the same manner as in Example 13, except that the 2-hour heat treatment at 200° C. (second-stage heat treatment) in the coating of zinc oxide is omitted.

TABLE 3

| | Volume resistivity of interlayer | | | | |
|---|---|---|---|---|---|
| | $\rho^1$ [Ω.cm] | $\rho^2$ [Ω.cm] | $\rho^3$ [Ω.cm] | $\rho^2/\rho^1$ | $\rho^1/\rho^3$ |
| Example 11 | $1 \times 10^8$ | $2 \times 10^9$ | $3 \times 10^5$ | 20 | 333 |
| Example 12 | $3 \times 10^9$ | $4 \times 10^{10}$ | $1 \times 10^6$ | 13 | 3000 |
| Example 13 | $9 \times 10^8$ | $5 \times 10^7$ | $2 \times 10^7$ | 0.06 | 45 |

(Evaluation of Fluctuation Inhibition of Residual Potential and Acceptance Potential)

The electrophotographic photoreceptors obtained in Examples 11 to 13 and Comparative Examples 6 to 8 each are subjected to the following steps (A) to (C) at ordinary temperature and ordinary pressure (20° C., 40% RH):

(A) a charging step in which the electrophotographic photoreceptor is charged with a scorotron charging device operated at a grid-applied voltage of 700 V;

(B) an exposure step in which at 1 second after step (A), the electrophotographic photoreceptor is irradiated at 10.0 erg/$cm^2$ with a light having a wavelength of 780 nm emitted from a semiconductor laser; and (C) an erase step in which at 3 seconds after step (A), the electrophotographic photoreceptor is illuminated at 50.0 erg/$cm^2$ with a red LED to remove any residual charges. Just after each of steps (A), (B), and (C), the electrophotographic photoreceptor is examined for potential (potentials $V_H$, $V_L$, and $V_{RP}$, respectively) with a scanner obtained by modifying a laser printer (XP-15, manufactured by Fuji Xerox Co., Ltd.). The values of $V_H$, $V_L$, and $V_{RP}$ in an initial stage and after 10,000 cycles are shown in Table 4.

The same test is conducted under low-temperature low-humidity conditions (10° C., 15% RH) and under high-temperature high-humidity conditions (28° C., 85% RH) to determine variations $\Delta V_H$, $\Delta V_L$, and $\Delta V_{RP}$ respectively from $V_H$, $V_L$, and $V_{RP}$, which are potentials as measured under the ordinary-temperature ordinary-pressure conditions. Environmental stability is evaluated based on these variations.

Furthermore, 100,000 cycles each consisting only of steps (A) and (B) described above are repeated to determine variations $\Delta V_H$, $\Delta V_L$, and $\Delta V_{RP}$ respectively from the values of $V_H$, $V_L$, and $V_{RP}$ as measured at the first cycle.

The results obtained in the tests described above are shown in Table 4. In Table 4, large values of $V_H$ mean that the electrophotographic photoreceptors have a high acceptance potential and could attain a high contrast. Small values of $V_L$ mean that the electrophotographic photoreceptors have high sensitivity. Small values of $V_{RP}$ mean that the electrophotographic photoreceptors have a low residual potential and are reduced in image memorization or fogging.

(Production of Electrophotographic Apparatus and Continuous Printing Test 2)

Electrophotographic apparatus are produced using the electrophotographic photoreceptors obtained in Examples 11 to 13 and Comparative Examples 6 to 8. These electrophotographic apparatus have the same constitution as full-color printer Docu Print C2220 (having a contact charging unit and an intermediate transfer unit), manufactured by Fuji Xerox Co., Ltd.

These electrophotographic apparatus are subjected to a 10,000-sheet continuous printing test. The 10,000th prints obtained in this test are evaluated for image quality. The results obtained are shown in Table 4.

| | Initial potential | | | Potential after 10,000 cycles | | | Environmental stability | | | Potential after 100,000 cycles of (A) and (B) only | | |
|---|---|---|---|---|---|---|---|---|---|---|---|---|
| | | | | | | | $\Delta V_H$ | $\Delta V_L$ | $\Delta V_{RP}$ | $\Delta V_H$ | $\Delta V_{RP}$ | Printing test |
| Example 11 | −690 | −55 | −35 | −690 | −50 | −30 | 20 | 25 | 20 | −60 | 230 | good |
| Example 12 | −695 | −50 | −30 | −690 | −55 | −35 | 20 | 25 | 20 | −50 | 200 | good |
| Example 13 | −690 | −35 | −20 | −690 | −45 | −25 | 15 | 15 | 10 | −40 | 150 | good |
| Comparative Example 6 | −650 | −40 | −20 | residual potential increased in 1000 cycles | | | 15 | 10 | 5 | −100 | 320 | many black spots, overall fogging |
| Comparative Example 7 | −700 | −50 | −25 | residual potential increased in 100 cycles | | | 20 | 20 | 15 | −80 | 300 | many black spots, overall fogging |
| Comparative Example 8 | −685 | −45 | −20 | residual potential increased in 2000 cycles | | | 20 | 15 | 10 | −55 | 280 | many black spots, overall fogging |

Table 4 shows the following. The electrophotographic photoreceptors of Examples 11 to 13 according to the invention are inhibited from fluctuating in residual potential and acceptance potential. At the time when 100,000 cycles of charging and exposure have been repeated, each of these electrophotographic photoreceptors have a residual potential of 250 V or lower. The electrophotographic apparatus respectively employing the electrophotographic photoreceptors of Examples 11 to 13 are capable of giving a satisfactory image even after 10,000-sheet printing.

Electrophotographic photoreceptors of Examples 14 to 17 are produced by the following procedure. These photoreceptors have the same constitution as the electrophotographic photoreceptor 1 shown in FIG. 5.

In forming the undercoat layer of each electrophotographic photoreceptor, the analysis of metal oxide particles A by fluorescent X-ray spectroscopy is conducted with a fluorescent X-ray spectrometer (trade name, System 3370E; manufactured by RIGAKU CORPORATION) under the conditions of an X-ray source target of rhodium, a voltage applied to the X-ray source of 50 kV, and a current of 50 mA. As the analyzing crystal of the optical system is used LiF, TAP, PET, or Ge according to the kind of the element to be detected in the metal oxide particles A to be analyzed. As detectors are used a scintillation counter and a photocounter. For scanning the spectrometer, the skip scanning method is used in which the angle for each step is set to 0.05°. Under these conditions, the intensity of characteristic X-ray is determined.

The specific surface area of metal oxide particles B or metal oxide particles A is measured with flow type automatic specific surface area analyzer FlowSorb II Type 2300 (manufactured by Shimadzu Corp.). Before the measurement, 200 mg of the metal oxide particles to be examined are degassed by heating at 200° C. for 30 minutes. The specific surface area thereof is then measure by the BET one-point method.

Example 14

A photoreceptor having the same constitution as the electrophotographic photoreceptor 1 shown in FIG. 5 is produced by the following procedure.

A hundred parts by weight of tin oxide (trade name, S1; manufactured by Mitsubishi Materials Corp.; specific surface area, 50 $m^2/g$) is mixed with 500 parts by weight of toluene with stirring. Thereto is added 15 parts by weight of a silane coupling agent (trade name, A1100; manufactured by Nippon Unicar Co., Ltd.). This mixture is stirred for 5 hours. Thereafter, the toluene is removed by vacuum distillation and the residue is baked at 100° C. for 2 hours.

The surface-treated tin oxide thus obtained is subjected to the fluorescent X-ray analysis. As a result, the "(intensity of characteristic X-ray for silicon, I1)/(intensity of characteristic X-ray for tin, I2)" is found to be $2.0\times10^{-4}$. The specific surface area of the surface-treated tin oxide is 60 $m^2/g$.

Subsequently, 35 parts by weight of the surface-treated tin oxide is mixed with 15 parts by weight of a hardener (blocked isocyanate Sumidule 3175, manufactured by Sumitomo Bayer Urethane Co., Ltd.), 6 parts by weight of butyral resin BM-1 (manufactured by Sekisui Chemical Co., Ltd.), and 44 parts by weight of methyl ethyl ketone. This mixture is subjected to a 2-hour dispersion treatment with a sand grinder-mill using 1-mm diameter glass beads. Thus, a dispersion is obtained.

To the dispersion obtained are added 0.005 parts by weight of dioctyltin dilaurate as a catalyst and 0.01 part by weight of silicone oil SH 29PA (manufactured by Dow Corning Toray Silicone Co., Ltd.). Thus, a coating fluid for interlayer formation is obtained. This coating fluid is applied by dip coating to an aluminum substrate (electroconductive support layer) having a diameter of 30 mm, length of 340 mm, and wall thickness of 1 mm. The coating is dried and cured at 160° C. for 100 minutes to form an interlayer having a thickness of 20 $\mu$m.

A photosensitive layer having a two-layer structure is then formed on the interlayer in the following manner. First, a mixture composed of 15 parts by weight of chlorogallium phthalocyanine, as a charge-generating material, which in examination by X-ray diffractometry with a CuK$\alpha$ ray, give a diffraction spectrum having diffraction peaks at least at Bragg angles (2$\theta$±0.2°) of 7.4°, 16.6°, 25.5°, and 28.3°, 10 parts by weight of a vinyl chloride/vinyl acetate copolymer resin (VMCH, manufactured by Nippon Unicar Co., Ltd.) as a binder resin, and 300 parts by weight of n-butyl acetate is subjected to a dispersion treatment with a sand grinder-mill using 1-mm diameter glass beads for 4 hours.

The dispersion obtained is applied, as a coating fluid for charge-generating-layer formation, to the interlayer by dip coating, and the coating is dried to form a charge-generating layer having a thickness of 0.2 $\mu$m.

To 80 parts by weight of chlorobenzene are added 4 parts by weight of N,N'-diphenyl-N,N'-bis(3-methylphenyl)-[1,1']-biphenyl-4,4'-diamine and 6 parts by weight of a bisphenol z polycarbonate resin (viscosity-average molecular weight, 40,000). The amine and resin are dissolved in the solvent. The resultant solution is applied, as a coating fluid for charge transport layer formation, to the charge-generating layer by dip coating, and the coating is dried at 130° C. for 40 minutes to form a charge transport layer having a thickness of 25 μm.

Example 15

A photoreceptor having the same constitution as the electrophotographic photoreceptor 1 shown in FIG. 5 is produced by the following procedure.

A liquid mixture of 10 parts by weight of toluene and 2 parts by weight of a silane coupling agent (trade name, KBM 503; manufactured by Shin-Etsu Chemical Co., Ltd.) is added to 100 parts by weight of titanium oxide (trade name, TAF 500J; manufactured by Fuji Titanium Co., Ltd.; specific surface area, 18 $m^2/g$) which is kept being stirred in a mixer. The resultant mixture is stirred for 10 minutes. Thereafter, the toluene is removed by vacuum distillation and the residue is baked at 170° C. for 2 hours.

The surface-treated titanium oxide thus obtained is subjected to the fluorescent X-ray analysis. As a result, the "(intensity of characteristic X-ray for silicon, I1)/(intensity of characteristic X-ray for titanium, I2)" is found to be $2.0\times10^{-4}$. The specific surface area of the surface-treated titanium oxide is 20 $m^2/g$.

Subsequently, 50 parts by weight of the surface-treated titanium oxide is mixed with 15 parts by weight of a hardener (blocked isocyanate Sumidule 3175, manufactured by Sumitomo Bayer Urethane Co., Ltd.), 6 parts by weight of butyral resin BM-1 (manufactured by Sekisui Chemical Co., Ltd.), and 60 parts by weight of methyl ethyl ketone. This mixture is subjected to a 4-hour dispersion treatment with a sand grinder-mill using 1-mm diameter glass beads. Thus, a dispersion is obtained.

To the dispersion obtained are added 0.005 parts by weight of dioctyltin dilaurate as a catalyst and 0.01 part by weight of silicone oil SH 29PA (manufactured by Dow Corning Toray Silicone Co., Ltd.). Thus, a coating fluid for interlayer formation is obtained. This coating fluid is applied by dip coating to an aluminum substrate (electroconductive support layer) having a diameter of 30 mm, length of 340 mm, and wall thickness of 1 mm. The coating is dried and cured at 160° C. for 100 minutes to form an interlayer having a thickness of 20 μm.

Thereafter, a charge-generating layer and a charge transport layer are successively formed in the same manner as in Example 14. Thus, an electrophotographic photoreceptor is produced.

Example 16

A photoreceptor having the same constitution as the electrophotographic photoreceptor 1 shown in FIG. 5 is produced by the following procedure.

A hundred parts by weight of zinc oxide (average particle diameter, 70 μm; trial product of Tayca Corp.; specific surface area, 15 $m^2/g$) is mixed with 500 parts by weight of toluene with stirring. Thereto is added 1.5 parts by weight of a silane coupling agent (trade name, KBM 603, manufactured by Shin-Etsu Chemical Co., Ltd.). The resultant mixture is stirred for 2 hours. Thereafter, the toluene is removed by vacuum distillation and the residue is baked at 150° C. for 2 hours.

The surface-treated zinc oxide thus obtained is subjected to the fluorescent X-ray analysis. As a result, the "(intensity of characteristic X-ray for silicon, I1)/(intensity of characteristic X-ray for zinc, I2)" is found to be $1.5\times10^{-5}$. The specific surface area of the surface-treated zinc oxide is 15 $m^2/g$.

Subsequently, 60 parts by weight of the surface-treated zinc oxide is mixed with 15 parts by weight of a hardener (blocked isocyanate Sumidule 3175, manufactured by Sumitomo Bayer Urethane Co., Ltd.), 15 parts by weight of butyral resin BM-1 (manufactured by Sekisui Chemical Co., Ltd.), and 85 parts by weight of methyl ethyl ketone. Eight parts by weight of the resultant liquid is mixed with 25 parts by weight of methyl ethyl ketone, and this mixture is subjected to a 2-hour dispersion treatment with a sand grinder-mill using 1-mm diameter glass beads. Thus, a dispersion is obtained.

To the dispersion obtained are added 0.005 parts by weight of dioctyltin dilaurate as a catalyst and 0.01 part by weight of silicone oil SH 29PA (manufactured by Dow Corning Toray Silicone Co., Ltd.). Thus, a coating fluid for interlayer formation is obtained. This coating fluid is applied by dip coating to an aluminum substrate (electroconductive substrate) having a diameter of 30 mm, length of 340 mm, and wall thickness of 1 mm. The coating is dried and cured at 160° C. for 100 minutes to form an interlayer having a thickness of 20 μm.

A photosensitive layer having a two-layer structure is then formed on the interlayer in the following manner. First, a mixture composed of 15 parts by weight of hydroxygallium phthalocyanine, as a charge-generating material, which in examination by X-ray diffractometry with a CuKα ray, give a diffraction spectrum having diffraction peaks at least at Bragg angles (2θ±0.2°) of 7.3°, 16.0°, 24.9°, and 28.0°, 10 parts by weight of a vinyl chloride/vinyl acetate copolymer resin (VMCH, manufactured by Nippon Unicar Co., Ltd.) as a binder resin, and 300 parts by weight of n-butyl acetate is subjected to a dispersion treatment with a sand grinder-mill using 1-mm diameter glass beads for 4 hours.

The dispersion obtained is applied, as a coating fluid for charge-generating-layer formation, to the interlayer by dip coating. The coating is dried to forma charge-generating layer having a thickness of 0.2 μm. A charge transport layer is then formed in the same manner as in Example 14. Thus, an electrophotographic photoreceptor is produced.

Example 17

A photoreceptor having the same constitution as the electrophotographic photoreceptor 1 shown in FIG. 5 is produced by the following procedure.

A hundred parts by weight of zinc oxide (trade name, MZ 300; manufactured by Tayca Corp.; specific surface area, 40 $m^2/g$) is mixed with 500 parts by weight of toluene with stirring. Thereto is added 5 parts by weight of a silane coupling agent (trade name, KBM 403, manufactured by Shin-Etsu Chemical Co., Ltd.). The resultant mixture is stirred for 2 hours. Thereafter, the toluene is removed by vacuum distillation and the residue is baked at 150° C. for 2 hours.

The surface-treated zinc oxide thus obtained is subjected to the fluorescent X-ray analysis. As a result, the "(intensity of characteristic X-ray for silicon, I1)/(intensity of characteristic X-ray for zinc, I2)" is found to be $5.0\times10^{-5}$. The specific surface area of the surface-treated zinc oxide is 30 $m^2/g$.

Subsequently, 60 parts by weight of the surface-treated zinc oxide is mixed with 15 parts by weight of a hardener (blocked isocyanate Sumidule 3175, manufactured by Sumitomo Bayer Urethane Co., Ltd.), 15 parts by weight of butyral resin BM-1 (manufactured by Sekisui Chemical Co., Ltd.), and 85 parts by weight of methyl ethyl ketone. Thirty-eight parts by weight of the resultant liquid is mixed with 25 parts by weight of methyl ethyl ketone, and this mixture is subjected to a 2-hour dispersion treatment with a sand grinder-mill using 1-mm diameter glass beads. Thus, a dispersion is obtained.

To the dispersion obtained are added 0.005 parts by weight of dioctyltin dilaurate as a catalyst and 0.01 part by weight of silicone oil SH 29PA (manufactured by Dow Corning Toray Silicone Co., Ltd.). Thus, a coating fluid for interlayer formation is obtained. This coating fluid is applied by dip coating to an aluminum substrate (electroconductive substrate) having a diameter of 30 mm, length of 340 mm, and wall thickness of 1 mm. The coating is dried and cured at 160° C. for 100 minutes to form an interlayer having a thickness of 20 $\mu$m.

A photosensitive layer having a two-layer structure is then formed on the interlayer in the following manner. First, a mixture composed of 15 parts by weight of hydroxytitanyl phthalocyanine, as a charge-generating material, which in examination by X-ray diffractometry with a CuK$\alpha$ ray, give a diffraction spectrum having a diffraction peak at least at a Bragg angle (2$\theta$±0.2°) of 27.3°, 10 parts by weight of a vinyl chloride/vinyl acetate copolymer resin (VMCH, manufactured by Nippon Unicar Co., Ltd.) as a binder resin, and 300 parts by weight of n-butyl acetate is subjected to a dispersion treatment with a sand grinder-mill using 1-mm diameter glass beads for 4 hours.

The dispersion obtained is applied, as a coating fluid for charge-generating-layer formation, to the interlayer by dip coating. The coating is dried to forma charge-generating layer having a thickness of 0.2 $\mu$m. A charge transport layer is then formed in the same manner as in Example 14. Thus, an electrophotographic photoreceptor is produced.

[Test for Evaluating Electrophotographic Properties of Electrophotographic Photoreceptors]

(1) Property Evaluation in Initial Stage of Use (Measurement of Initial Potential)

The electrophotographic photoreceptors of Examples 14 to 17 each are mounted on a laser printer/scanner (a modification of XP-15 (trade name), manufactured by Fuji Xerox Co., Ltd.) having the same structure as the electrophotographic apparatus shown in FIG. 12, and evaluated for electrophotographic properties in the following manners.

In an ordinary-temperature ordinary-humidity (20° C., 40% RH) atmosphere, each electrophotographic photoreceptor is charged with a scorotron charging device operated at a grid-applied voltage of 700 V, and the surface potential A [V] of the electrophotographic photoreceptor is measured just after this charging. At 1 second after the charging, each electrophotographic photoreceptor is irradiated at 10 mJ/m$^2$ with a 780-nm semiconductor laser light to cause the photoreceptor to undergo discharge. The surface potential B [V] of each electrophotographic photoreceptor is measured just after this discharge. At 3 seconds after the discharge, each electrophotographic photoreceptor is illuminated at 50 mJ/m$^2$ with a red LED to remove any residual charges. The surface potential C [V] of each electrophotographic photoreceptor is measured just after this erase step.

The higher the value of potential A is, the higher the acceptance potential of the electrophotographic photoreceptor is. This photoreceptor hence can attain a high contrast. The lower the value of potential B is, the higher the sensitivity of the electrophotographic photoreceptor is. Furthermore, the lower the value of potential C is, the lower the residual potential of the electrophotographic photoreceptor is. This photoreceptor is regarded as less apt to cause image memorization or fogging. The results of those measurements are shown in Table 5.

(2) Property Evaluation After Repetitions of Use

The operation described above is repeated 10,000 times. Thereafter, the potentials A to C are measured after charging, exposure, and erase. The results obtained are shown in Table 5.

(3) Evaluation of Stability to Change in Ambient Conditions

The operation described above is conducted in two different atmospheres, i.e., a low-temperature low-humidity (10° C., 15% RH) atmosphere and a high-temperature high-humidity (28° C., 85% RH) atmosphere to measure the potentials A to C after charging, exposure, and erase. Variations (AA, AB, and AC) in potentials A to C between these different atmospheres are determined to evaluate the stability of each electrophotographic photoreceptor to changes in ambient conditions. The results obtained are shown in Table 5.

(4) Image Quality Evaluation After 10,000-Sheet Printing

The electrophotographic photoreceptors of Examples 14 to 17 each are mounted on a full-color printer (trade name, Docu Print C620; manufactured by Fuji Xerox Co., Ltd.), which has a contact charging unit and an intermediate transfer unit and has the same structure as the electrophotographic apparatus shown in FIG. 4. This printer is used to conduct a continuous printing test in which 10,000 sheets of paper are printed.

After the 10,000-sheet printing, the image quality is evaluated based on the following criteria: "no abnormality" . . . satisfactory image quality is obtained; "overall fogging" . . . minute black spots are observed on the print throughout; and "black spots" . . . large black spots are observed on the print. The results obtained are shown in Table 5.

TABLE 5

| | Initial potential | | | Potential after 10,000 cycles | | | Environmental stability | | | Evaluation after 10,000-sheet printing test |
|---|---|---|---|---|---|---|---|---|---|---|
| | Potential A/V | Potential B/V | Potential C/V | Potential A/V | Potential B/V | Potential C/V | ΔA/V | ΔB/V | ΔC/V | |
| Example 1 | −695 | −50 | −30 | −695 | −55 | −35 | 20 | 25 | 20 | no abnormality |
| Example 2 | −700 | −45 | −25 | −695 | −50 | −30 | 20 | 25 | 20 | no abnormality |

TABLE 5-continued

| | Initial potential | | | Potential after 10,000 cycles | | | Environmental stability | | | Evaluation after 10,000-sheet printing test |
|---|---|---|---|---|---|---|---|---|---|---|
| | Potential A/V | Potential B/V | Potential C/V | Potential A/V | Potential B/V | Potential C/V | ΔA/V | ΔB/V | ΔC/V | |
| Example 3 | −680 | −30 | −15 | −675 | −35 | −15 | 15 | 15 | 10 | no abnormality |
| Example 4 | −700 | −30 | −15 | −695 | −30 | −15 | 15 | 15 | 15 | no abnormality |

As described above, in the electrophotographic photoreceptor of the invention, an interlayer which comprises fine metal oxide particles and a binder resin and satisfies the requirements concerning volume resistivity and its dependence on the environment has been formed between the electroconductive substrate and the photosensitive layer. Due to this constitution, both of leakage preventive properties and electrical properties are sufficiently enhanced. Consequently, even when the electrophotographic photoreceptor is used together with a contact charging unit, it can attain satisfactory image quality without causing image quality defects such as fogging.

In the processes of the invention for producing an electrophotographic photoreceptor, an interlayer which satisfies the requirements concerning volume resistivity and its dependence on the environment can be easily formed without fail because fine metal oxide particles which have undergone a surface treatment with a given coupling agent and a heat treatment are used as a component of the interlayer. As a result, the electrophotographic photoreceptor thus obtained combines sufficiently high leakage preventive properties and sufficiently high electrical properties. Because of this, even when the photoreceptor is used together with a contact charging unit, it can attain satisfactory image quality without causing image quality defects such as fogging.

The process cartridge and electrophotographic apparatus of the invention each have a contact charging unit. Use of the contact charging unit in combination with the electrophotographic photoreceptor of the invention reconciles a high level of leakage preventive properties with a high level of electrical properties. Consequently, the effect that satisfactory image quality is obtained without causing image quality defects such as fogging is produced, although it has been extremely difficult to attain this effect with any of the usual process cartridges and electrophotographic apparatus having a contact charging unit.

Furthermore, according to the processes of the invention, an electrophotographic photoreceptor can be provided which has such high durability that its electrical properties can be sufficiently prevented from decreasing with repetitions of use and which attains high resolution quality. Due to this electrophotographic photoreceptor, it is possible to provide a process cartridge and an electrophotographic apparatus which retain high resolution quality even when repeatedly used over long.

What is claimed is:

1. An electrophotographic photoreceptor comprising:

an electroconductive substrate;

an interlayer formed on the substrate; and a photosensitive layer formed on the interlayer, wherein the interlayer comprises fine metal oxide particles and a binder resin;

wherein the interlayer has a volume resistivity in a range of from $10^8$ to $10^{13}$ Ω·cm, when electric field of $10^6$ V/m is applied thereto at 28° C. and 85% RH;

wherein the volume resistivity of the interlayer at a time when an electric field of $10^6$ V/m is applied thereto at 15° C. and 15% RH is not higher than 500 times of the volume resistivity thereof at a time when an electric field of $10^6$ V/m is applied thereto at 28° C. and 85% RH.

2. The electrophotographic photoreceptor according to claim 1, wherein the fine metal oxide particles are ones obtained through a surface treatment with at least one coupling agent selected from the group consisting of silane coupling agents, titanate coupling agents, and aluminate coupling agents and a subsequent heat treatment at 180° C. or higher.

3. The electrophotographic photoreceptor according to claim 2, wherein the coupling agent is a compound having an amino group.

4. The electrophotographic photoreceptor according to claim 1, wherein the fine metal oxide particles are ones obtained through a surface treatment with a treating liquid comprising a given solvent and at least one coupling agent selected from the group consisting of silane coupling agents, titanate coupling agents, and aluminate coupling agents, a subsequent heat treatment at a first heat treatment temperature, and then another heat treatment at a second heat treatment temperature.

5. The electrophotographic photoreceptor according to claim 4, wherein the first heat treatment temperature is not lower than the boiling point of the solvent; and wherein the second heat treatment temperature is not lower than 180° C.

6. The electrophotographic photoreceptor according to claim 1, wherein when repeatedly subjected to 100,000 cycles each consisting only of charging and exposure, fluctuations in residual potential is not higher than 250 V.

7. The electrophotographic photoreceptor according to claim 1, wherein the photosensitive layer contains a pigment;

wherein the interlayer contains fine metal oxide particles which have been subjected to surface treatment with an organometallic compound having a hydrolyzable functional group;

wherein the surface-treated fine metal oxide particles satisfying a requirement represented by the following expression (1):

$$1.0\times10^{-6}\leq(I1/I2)\leq1.0\times10^{-3} \quad (1)$$

where I1 is the intensity of characteristic X-ray for a metal element serving as a component of the organometallic compound, the intensity of characteristic X-ray obtained through analysis of the surface-treated metal oxide particles by fluorescent X-ray spectroscopy; and I2 is the intensity of characteristic X-ray for the metal element serving as a component of the surface-treated metal oxide particles, the intensity of characteristic X-ray obtained through the analysis of the surface-treated metal oxide particles by fluorescent X-ray spectroscopy.

8. The electrophotographic photoreceptor according to claim 1, wherein the interlayer has a thickness in a range of from 15 $\mu$m to 50 $\mu$m.

9. A process for producing an electrophotographic photoreceptor in which an interlayer and a photosensitive layer are formed over an electroconductive substrate, the process comprising the steps of:

surface-treating fine metal oxide particles with at least one coupling agent selected from the group consisting of silane coupling agents, titanate coupling agents, and aluminate coupling agents;

heat-treating the surface-treated fine metal oxide particles at 180° C. or higher;

adding the heat-treated fine metal oxide particles and a binder resin to a given solvent to thereby obtain a coating fluid;

applying the coating fluid to an electroconductive substrate; and drying the coating fluid applied;

to thereby obtain the interlayer, wherein a volume resistivity thereof is in a range of from $10^8$ to $10^{13}$ Ω·cm when an electric field of $10^6$ V/m is applied thereto at 28° C. and 85% RH, and the volume resistivity thereof at a time when an electric field of $10^6$ V/m is applied thereto at 15° C. and 15% RH is not more than 500 times of the volume resistivity thereof at a time when an electric field of $10^6$ V/m is applied thereto at 28° C. and 85% RH; and forming the photosensitive layer on the interlayer.

10. The process according to claim 9, wherein the interlayer has a thickness in a range of from 15 to 50 $\mu$m.

11. A process for producing an electrophotographic photoreceptor in which an interlayer and a photosensitive layer are formed over an electroconductive substrate, the process comprising the steps of:

surface-treating fine metal oxide particles with a treating liquid comprising a given solvent and at least one coupling agent selected from the group consisting of silane coupling agents, titanate coupling agents, and aluminate coupling agents;

heat-treating the surface-treated fine metal oxide particles at a first heat treatment temperature;

heat-treating at a second heat treatment temperature the fine metal oxide particles, which have been heat-treated at the first heat treatment temperature;

adding the fine metal oxide particles heat-treated at the second heat treatment temperature and a binder resin to a given solvent to thereby obtain a coating fluid;

applying the coating fluid to an electroconductive substrate; and drying the coating fluid applied;

to thereby obtain the interlayer, wherein a volume resistivity thereof is in a range of from $10^8$ to $10^{-3}$ Ω·cm when an electric field of $10^6$ V/m is applied thereto at 28° C. and 85% RH, and the volume resistivity thereof at a time when an electric field of $10^6$ V/m is applied thereto at 15° C. and 15% RH is not more than 500 times of the volume resistivity thereof at a time when an electric field of $10^6$ V/m is applied thereto at 28° C. and 85% RH; and forming the photosensitive layer on the interlayer.

12. The process according to claim 11, wherein the first heat treatment temperature is not lower than the boiling point of the solvent; and wherein the second heat treatment temperature is 180° C. or higher.

13. A process cartridge comprising:

an electrophotographic photoreceptor; and at least one of a charging unit, a development unit, a cleaning unit, an erase unit, and a transfer unit, wherein the electrophotographic photoreceptor is integrally formed with the at least one of the charging unit, the devepment unit, the cleaning unit, the erase unit, and the transfer unit;

wherein the electrophotographic photoreceptor comprises an electroconductive substrate, an interlayer formed on the substrate, and a photosensitive layer formed on the interlayer;

wherein the interlayer comprises fine metal oxide particles and a binder resin; and wherein the interlayer has a volume resistivity in a range of from $10^8$ to $10^{13}$ Ω·cm, when electric field of $10^6$ V/m is applied thereto at 28° C. and 85% RH;

wherein the volume resistivity of the interlayer at a time when an electric field of $10^6$ V/m is applied thereto at 15° C. and 15% RH is not higher than 500 times of the volume resistivity thereof at a time when an electric field of $10^6$ V/m is applied thereto at 28° C. and 85% RH; and wherein the process cartridge can be freely attached to and removed from a main body of an electrophotographic apparatus.

14. The process cartridge according to claim 13, wherein the charging unit is a contact charging unit, which comes into contact with surface of the photoreceptor and charges the photoreceptor.

15. The process cartridge according to claim 13, wherein the transfer unit is a transfer unit which transfers a toner image formed on the photoreceptor surface to an intermediate transfer member and transfers the toner image transferred on the intermediate transfer member to a transferred material.

16. An electrophotographic apparatus comprising an electrophotographic photoreceptor;

a charging unit for charging the electrophotographic photoreceptor;

an exposure unit for exposing the electrophotographic photoreceptor charged by the charging unit to form an electrostatic latent image;

a development unit for developing the electrostatic latent image with a toner to form a toner image; and a transfer unit for transferring the toner image to a receiving medium, wherein the electrophotographic photoreceptor comprises an electroconductive substrate, an interlayer formed on the substrate, and a photosensitive layer formed on the interlayer;

wherein the interlayer has a volume resistivity in a range of from $10^8$ to $10^{13}$ Ω·cm, when electric field of $10^6$ V/m is applied thereto at 28° C. and 85% RH; and wherein the volume resistivity of the interlayer at a time when an electric field of $10^6$ V/m is applied thereto at 15° C. and 15% RH is not higher than 500 times of the volume resistivity thereof at a time when an electric field of $10^6$ V/m is applied thereto at 28° C. and 85% RH.

17. The electrophotographic apparatus according to claim 16, wherein the charging unit is a contact charging unit, which comes into contact with surface of the photoreceptor and charges the photoreceptor.

18. The electrophotographic apparatus according to claim 16, wherein the transfer unit is a transfer unit, which transfers a toner image formed on the photoreceptor surface to an intermediate transfer member and transfers the toner image transferred on the intermediate transfer member to a transferred material.

* * * * *